US012377944B2

(12) United States Patent
Eldred

(10) Patent No.: US 12,377,944 B2
(45) Date of Patent: Aug. 5, 2025

(54) ANCHOR SYSTEM, METHOD AND MECHANISM FOR AN UNDERWATER VEHICLE

(71) Applicant: THE UNITED STATES OF AMERICA, AS REPRESENTED BY THE SECRETARY OF THE NAVY, Arlington, VA (US)

(72) Inventor: Ross Anthony Eldred, Salinas, CA (US)

(73) Assignee: The Government of the United States of America, as represented by the Secretary of the Navy, Alington, VA (US)

( * ) Notice: Subject to any disclaimer, the term of this patent is extended or adjusted under 35 U.S.C. 154(b) by 451 days.

(21) Appl. No.: 18/106,875

(22) Filed: Feb. 7, 2023

(65) Prior Publication Data

US 2023/0182876 A1 Jun. 15, 2023

Related U.S. Application Data

(60) Provisional application No. 63/287,957, filed on Dec. 9, 2021.

(51) Int. Cl.

| | |
|---|---|
| ***B63G 8/00*** | (2006.01) |
| ***B63B 21/26*** | (2006.01) |
| ***B63G 8/14*** | (2006.01) |

(52) U.S. Cl.

CPC ..... *B63G 8/001* (2013.01); *B63B 21/26* (2013.01); *B63G 8/14* (2013.01); *B63G 2008/008* (2013.01)

(58) Field of Classification Search

CPC ..... B63G 8/001; B63G 21/26; B63G 8/14; B63G 2008/008; B63G 8/16; B63G 2008/004

USPC ..... 114/294

See application file for complete search history.

(56) References Cited

U.S. PATENT DOCUMENTS 9,381,986 B2 7/2016 Brizard

FOREIGN PATENT DOCUMENTS

CN 222408505 U * 1/2025
WO WO-2025037067 A1 * 2/2025 ..... B63G 8/001

OTHER PUBLICATIONS

Translation CN-222408505-U, see fig. 6, (Year: 2025).*

(Continued)

*Primary Examiner* — J. Todd Newton

(74) *Attorney, Agent, or Firm* — Scott Bell; Heber Martin Carbajal

(57) ABSTRACT

Disclosed is a method and system to provide a Resetting Anchor/Antenna Tether Mechanism (RAATM) to provide, according to an exemplary embodiment, dual anchoring and antenna capabilities to autonomous underwater vehicles (AUVs). The RAATM is resettable; an AUV can anchor at one location for a period of time, retrieve the anchor, move to a new location, and redeploy the anchor. Furthermore, the RAATM tether may also be used as an antenna for radio communications while deployed; this may allow smaller AUVs to accomplish missions that would otherwise require larger AUVs with dedicated antennas.

20 Claims, 19 Drawing Sheets
(15 of 19 Drawing Sheet(s) Filed in Color)

(56) References Cited

OTHER PUBLICATIONS

Bird, C.E.; Franklin, E.C.; Smith, C.M.; Toonen, R.J. Between tide and wave marks: A unifying model of physical zonation on littoral shores. PeerJ 2013, 1, e154.
Williams, D.L. Loitering Behaviors of Autonomous Underwater Vehicles; Technical Report; Naval Postgraduate School: Monterey, CA, USA, 2002.
Eldred, R.; Lussier, J.; Pollman, A. Design and Testing of a Spherical Autonomous Underwater Vehicle for Shipwreck Interior Exploration. J. Mar. Sci. Eng. 2021, 9, 320. https://doi.org/10.3390/jmse9030320.
Richmond, K.; Gulati, S.; Flesher, C.; Hogan, B.P.; Stone, W.C. Navigation, control, and recovery of the Endurance under-ice hovering AUV. In Proceedings of the 16th Annual International Symposium on Unmanned Untethered Submersible Technology (UUST), Durham, NH, USA, Aug. 23-26, 2009.
Gary, M.; Fairfield, N.; Stone, W.C.; Wettergreen, D.; Kantor, G.; Sharp, J.M., Jr. 3D mapping and characterization of Sistema Zacatón from Depthx (DE ep P hreatic TH ermal e X plorer). In Sinkholes and the Engineering and Environmental Impacts of Karst; American Society of Civil Engineers (ASCE): Reston, VA, USA, 2008; pp. 202-212.
Milosevic, Z.; Fernandez, R.A.S.; Dominguez, S.; Rossi, C. Guidance for Autonomous Underwater Vehicles in Confined Semistructured Environments. Sensors 2020, 20, 7237.
Pyo, J.; Yu, S.C.; Park, J.C.; Park, S.C. Development of a robotic anchoring system for underwater vehicle under water current. In Proceedings of the 2012 Oceans, Yeosu, Korea, May 21-24, 2012; pp. 1-5.
McCarter, B.; Briggs, R.; Portner, S.; Stilwell, D.; Neu, W.; Coe, R.; Duelley, R.; Malley, D.; Mims, J. Design and testing of a self-mooring AUV. In Proceedings of the 2012 Oceans, Hampton Roads, VA, USA, Oct. 14-19, 2012; pp. 1-8.
Bin-Karim, S.; Muglia, M.; Mazzoleni, A.; Vermillion, C. Control of a relocatable energy-harvesting autonomous underwater vehicle in a spatiotemporally-varying gulf stream resource. In Proceedings of the 2018 Annual American Control Conference (ACC), Milwaukee, Wi, USA, Jun. 27-29, 2018; pp. 2575-2580.
Tandon, S.; Divi, S.; Muglia, M.; Vermillion, C.; Mazzoleni, A. Modeling and dynamic analysis of a mobile underwater turbine system for harvesting marine hydrokinetic energy. Ocean. Eng. 2019, 187, 106069.
Bin-Karim, S.; Muglia, M.; Vermillion, C. Centralized position optimization of multiple agents in spatiotemporally-varying environment: A case study with relocatable energy-harvesting autonomous underwater vehicles in the gulf stream. In Proceedings of the 2019 IEEE Conference on Control Technology and Applications (CCTA), Hong Kong, China, Aug. 19-21, 2019; pp. 264-269.
Reed, J.; Daniels, J.; Siddiqui, A.; Cobb, M.; Vermillion, C. Optimal exploration and charging for an autonomous underwater vehicle with energy-harvesting kite. In Proceedings of the 2020 American Control Conference (ACC), Denver, CO, USA, Jul. 1-3, 2020; pp. 4134-4139.
Zheng, M.; Wang, L.; Stoner, R.; Coates, R. Underwater digital communication utilising parametric sonar with M-ary DPSK modulation. IEE Proc. Radar Sonar Navig. 1999, 146, 213-218.
Yusof, M.A.B.; Kabir, S. An overview of sonar and electromagnetic waves for underwater communication. IETE Tech. Rev. 2012, 29, 307-317.
Li, Y.; Yin, H.; Ji, X.; Wu, B. Design and implementation of underwater wireless optical communication system with high-speed and full-duplex using blue/green light. In Proceedings of the 10th International Conference on Communication Software and Networks (ICCSN), Chengdu, China, Jul. 6-9, 2018; pp. 99-103.
Gough, P.T.; Hawkins, D.W. A short history of synthetic aperture sonar. In Proceedings of the IGARSS'98. Sensing and Managing the Environment. 1998 IEEE International Geoscience and Remote Sensing. Symposium Proceedings. (Cat. No. 98CH36174), Seattle, WA, USA, Jul. 6-10, 1998; vol. 2, pp. 618-620.
Wiener, T.; Karp, S. The role of blue/green laser systems in strategic submarine communications. IEEE Trans. Commun. 1980, 1602-1607.
Wang, M.; Yuan, X.; AlHarbi, O.; Deng, P.; Kane, T. Propagation of laser beams through air-sea turbulence channels. In Laser Communication and Propagation through the Atmosphere and Oceans VII: Proceedings of the SPIE Optical Engineering and Applications, San Diego, CA, USA, Aug. 19-23, 2018; International Society for Optics and Photonics: Bellingham, WA, USA, 2018; vol. 10770, p. 1077003.
Inácio, S.I.; Pereira, M.R.; Santos, H.M.; Pessoa, L.M.; Teixeira, F.B.; Lopes, M.J.; Aboderin, O.; Salgado, H. Antenna design for underwater radio communications. In Proceedings of the Oceans 2016, Shanghai, China, Apr. 10-13, 2016; pp. 1-6.
Kelley, B.; Naishadham, K. RF multicarrier signaling and antenna systems for low SNR broadband underwater communications. In Proceedings of the IEEE Topical Conference on Power Amplifiers for Wireless and Radio Applications, Austin, TX, USA, Jan. 20-23, 2013; pp. 169-171.
Smolyaninov, I.; Balzano, Q.; Young, D. Development of broadband underwater radio communication for application in unmanned underwater vehicles. J. Mar. Sci. Eng. 2020, 8, 370.
Rogers, R.L.; Buhl, D.P. Clandestine ELOS/OTH RF Communications for Unmanned Underwater Vehicles; Technical Report; Applied Research Laboratories, University of Texas: Austin, TX, USA, 2002.
Aboderin, O.; Pessoa, L.M.; Salgado, H.M. Performance evaluation of antennas for underwater applications. In Proceedings of the Wireless Days, Porto, Portugal, Mar. 29-31, 2017; pp. 194-197.
Fessenden, C.; Cheng, D. Development of a trailing-wire E-field submarine antenna for extremely low frequency (ELF) reception. IEEE Trans. Commun. 1974, 22, 428-437.
Palmeiro, A.; Martin, M.; Crowther, I.; Rhodes, M. Underwater radio frequency communications. In Proceedings of the Oceans 2011 IEEE, Santander, Spain, Jun. 6-9, 2011; pp. 1-8.
Potter, J.; Alves, J.; Green, D.; Zappa, G.; Nissen, I.; McCoy, K. The JANUS underwater communications standard. In Proceedings of the 2014 Underwater Communications and Networking (UComms), Sestri Levante, Italy, Sep. 3-5, 2014; pp. 1-4.
Alves, J.; Furfaro, T.; LePage, K.; Munafò, A.; Pelekanakis, K.; Petroccia, R.; Zappa, G. Moving JANUS forward: A look into the future of underwater communications interoperability. In Proceedings of the Oceans 2016 MTS/IEEE, Monterey, CA, USA, Sep. 19-23, 2016; pp. 1-6.
Xie, P.; Zhou, Z.; Peng, Z.; Cui, J.H.; Shi, Z. SDRT: A reliable data transport protocol for underwater sensor networks. Ad Hoc Netw. 2010, 8, 708-722.
Luo, Y.; Pu, L.; Peng, Z.; Zhou, Z.; Cui, J.H. CT-MAC: a Mac protocol for underwater MIMO based network uplink communications. In Proceedings of the Seventh ACM International Conference on Underwater Networks and Systems, Los Angeles, CA, USA, Nov. 5-6, 2012; pp. 1-8.
Akyildiz, I.F.; Pompili, D.; Melodia, T. State-of-the-art in protocol research for underwater acoustic sensor networks. In Proceedings of the 1st ACM International Workshop on Underwater Networks, Los Angeles, CA, USA, Sep. 25, 2006; pp. 7-16.
Yoon, S.; Azad, A.K.; Oh, H.; Kim, S. Aurp: An AUV-aided underwater routing protocol for underwater acoustic sensor networks. Sensors 2012, 12, 1827-1845.
Assallay, A.; Rogers, C.; Smalley, I.; Jefferson, I. Silt: 2-62 _m, 9-4j. Earth-Sci. Rev. 1998, 45, 61-88.
Guggenheim, S.; Martin, R. Definition of clay and clay mineral: Joint report of the AIPEA nomenclature and CMS nomenclature committees. Clays Clay Miner. 1995, 43, 255-256.

* cited by examiner

Table A1. Test 1: complete anchoring failure tension data (lbf).

| TEST 1 | | | |
|---|---|---|---|
| 4″ Spike + 8 Wire Root Array (Straight Pull) | | | |
| | Condition 1 | Condition 2 | Condition 3 |
| Pull # | Clay/Pebble Mixture | Fine Silt | Beach Sand |
| 1 | 21.2 | 12.1 | 2.3 |
| 2 | 17.9 | 17.3 | 2.5 |
| 3 | 17.2 | 16.8 | 4.0 |
| 4 | 12.2 | 22.0 | 3.2 |
| 5 | 12.2 | 22.0 | 4.0 |
| 6 | 10.6 | 19.0 | 5.8 |
| 7 | 15.6 | 18.4 | 2.5 |
| 8 | 16.3 | 14.2 | 6.0 |
| 9 | 13.2 | 12.0 | 4.0 |
| 10 | 20.8 | 14.0 | 4.8 |
| 11 | 14.0 | 13.5 | 4.9 |
| 12 | 15.8 | 15.0 | 6.8 |
| 13 | 19.8 | 17.0 | 4.1 |
| 14 | 15.1 | 14.9 | 4.5 |
| 15 | 14.8 | 14.0 | 3.5 |
| 16 | 14.5 | 15.2 | 5.0 |
| 17 | 18.0 | 18.1 | 4.2 |
| 18 | 17.0 | 13.8 | 3.4 |
| 19 | 13.0 | 15.1 | 4.2 |
| 20 | 20.0 | 12.7 | 4.1 |
| 21 | 15.2 | 20.0 | 3.6 |
| 22 | 12.9 | 12.5 | 5.1 |
| 23 | 16.9 | 15.4 | 5.2 |
| 24 | 28.0 | 12.6 | 4.0 |
| 25 | 19.9 | 24.9 | 3.3 |
| 26 | 17.0 | 12.5 | 3.9 |
| 27 | 18.2 | 20.8 | 4.5 |
| 28 | 14.9 | 19.1 | 5.0 |
| 29 | 20.8 | 14.8 | 5.3 |
| 30 | 25.0 | 13.6 | 4.9 |
| Avg: | 16.9 | 16.1 | 4.3 |

FIG. 16

Table A2. Test 2: complete anchoring failure tension data (lbf).

| TEST 2 | | | |
|---|---|---|---|
| 4″ Spike + 4 Wire Root Array (Straight Pull) | | | |
| | Condition 1 | Condition 2 | Condition 3 |
| Pull # | Clay/Pebble Mixture | Fine Silt | Beach Sand |
| 1 | 14.0 | 21.5 | 3.0 |
| 2 | 18.2 | 31.0 | 3.0 |
| 3 | 22.0 | 17.9 | 3.7 |
| 4 | 18.0 | 34.0 | 3.9 |
| 5 | 18.2 | 18.0 | 4.0 |
| 6 | 15.3 | 28.2 | 2.2 |
| 7 | 18.0 | 30.2 | 2.8 |
| 8 | 22.8 | 37.3 | 4.0 |
| 9 | 18.0 | 42.2 | 3.9 |
| 10 | 18.0 | 34.8 | 3.3 |
| 11 | 21.4 | 27.9 | 5.2 |
| 12 | 18.0 | 33.5 | 2.9 |
| 13 | 18.0 | 30.5 | 4.5 |
| 14 | 18.0 | 36.9 | 4.9 |
| 15 | 19.3 | 30.8 | 3.8 |
| 16 | 13.5 | 27.2 | 5.2 |
| 17 | 19.0 | 22.3 | 5.2 |
| 18 | 20.9 | 32.9 | 4.1 |
| 19 | 23.0 | 20.5 | 4.0 |
| 20 | 18.0 | 17.2 | 4.2 |
| 21 | 20.0 | 32.1 | 3.8 |
| 22 | 14.0 | 34.0 | 4.9 |
| 23 | 25.2 | 43.3 | 3.0 |
| 24 | 22.9 | 30.8 | 4.0 |
| 25 | 17.0 | 31.4 | 5.3 |
| 26 | 23.3 | 36.5 | 3.4 |
| 27 | 25.8 | 33.0 | 4.9 |
| 28 | 18.0 | 28.9 | 4.5 |
| 29 | 17.5 | 40.8 | 3.3 |
| 30 | 22.6 | 32.4 | 3.5 |
| Avg: | 19.3 | 30.9 | 3.9 |

FIG. 17

Table A3. Test 3: complete anchoring failure tension data (lbf).

| TEST 3 | | | |
|---|---|---|---|
| 4″ Spike Only (Straight Pull) | | | |
| | Condition 1 | Condition 2 | Condition 3 |
| Pull # | Clay/Pebble Mixture | Fine Silt | Beach Sand |
| 1 | 10.2 | 16.1 | 3.0 |
| 2 | 18.3 | 17.9 | 2.6 |
| 3 | 10.8 | 17.1 | 1.9 |
| 4 | 11.0 | 17.9 | 1.8 |
| 5 | 13.5 | 18.0 | 1.9 |
| 6 | 13.6 | 15.3 | 1.2 |
| 7 | 18.6 | 10.9 | 1.6 |
| 8 | 17.0 | 12.1 | 1.5 |
| 9 | 11.0 | 18.5 | 2.0 |
| 10 | 10.9 | 15.9 | 2.0 |
| 11 | 18.0 | 8.2 | 1.8 |
| 12 | 18.0 | 8.3 | 2.0 |
| 13 | 15.9 | 18.1 | 2.3 |
| 14 | 14.2 | 17.8 | 2.1 |
| 15 | 10.9 | 17.8 | 1.9 |
| 16 | 11.5 | 8.9 | 2.1 |
| 17 | 13.6 | 17.4 | 2.0 |
| 18 | 18.5 | 15.2 | 1.9 |
| 19 | 18.5 | 15.5 | 1.7 |
| 20 | 17.0 | 15.0 | 2.5 |
| 21 | 17.4 | 16.9 | 2.3 |
| 22 | 18.8 | 18.8 | 1.8 |
| 23 | 13.0 | 18.0 | 2.0 |
| 24 | 18.0 | 13.1 | 2.1 |
| 25 | 17.0 | 15.0 | 2.0 |
| 26 | 13.4 | 15.0 | 2.0 |
| 27 | 18.0 | 15.0 | 1.8 |
| 28 | 15.0 | 19.0 | 2.1 |
| 29 | 17.1 | 9.0 | 1.8 |
| 30 | 20.8 | 18.4 | 2.0 |
| Avg: | 15.3 | 15.9 | 2.0 |

FIG. 18

Table A4. Test 4: complete anchoring failure tension data (lbf).

| TEST 4 | | | |
|---|---|---|---|
| 4" Spike + 8 Wire Root Array (Angled Pull) | | | |
| | Condition 1 | Condition 2 | Condition 3 |
| Pull # | Clay/Pebble Mixture | Fine Silt | Beach Sand |
| 1 | 17.9 | 18.7 | 4.0 |
| 2 | 26.7 | 27.1 | 2.8 |
| 3 | 22.1 | 26.2 | 3.0 |
| 4 | 13.0 | 28.8 | 3.0 |
| 5 | 21.0 | 24.5 | 4.0 |
| 6 | 20.8 | 19.0 | 3.2 |
| 7 | 23.0 | 20.3 | 2.3 |
| 8 | 21.0 | 20.8 | 3.0 |
| 9 | 29.2 | 19.0 | 4.3 |
| 10 | 24.4 | 21.0 | 2.8 |
| Avg: | 21.9 | 22.5 | 3.2 |

FIG. 19

Table A5. Test 5: complete anchoring failure tension data (lbf).

| TEST 5 | | | |
|---|---|---|---|
| 4" Spike Only (Angled Pull) | | | |
| | Condition 1 | Condition 2 | Condition 3 |
| Pull # | Clay/Pebble Mixture | Fine Silt | Beach Sand |
| 1 | 14.0 | 9.8 | 1.5 |
| 2 | 15.8 | 10.5 | 1.0 |
| 3 | 11.1 | 13.0 | 1.4 |
| 4 | 15.3 | 12.1 | 1.2 |
| 5 | 20.1 | 10.2 | 1.0 |
| 6 | 19.0 | 12.2 | 1.0 |
| 7 | 16.2 | 14.1 | 1.5 |
| 8 | 9.5 | 10.0 | 1.2 |
| 9 | 22.0 | 14.2 | 1.0 |
| 10 | 11.5 | 14.5 | 1.2 |
| Avg: | 15.5 | 12.1 | 1.2 |

FIG. 20

ANCHOR SYSTEM, METHOD AND MECHANISM FOR AN UNDERWATER VEHICLE

CROSS REFERENCE TO RELATED PATENT(S) AND APPLICATION(S)

This application claims the benefit of U.S. Provisional Application No. 63/287,957, filed Dec. 9, 2021, and entitled Resetting, Anchor, Antenna and Tether Mechanism for an Autonomous Underwater Vehicle, which is hereby incorporated in its entirety by reference.

BACKGROUND

This disclosure, and the exemplary embodiments described herein, describe an anchor system, method, and mechanism for an underwater vehicle. The implementation described herein is related to an autonomous underwater vehicle anchoring system, method, and mechanism, including the incorporation of an antenna type communication system, however it is to be understood that the scope of this disclosure is not limited to such application.

The present disclosure, and exemplary embodiments provided herein, is specifically directed to a resetting, anchor and tether mechanism, which may also serve as an antenna, for an autonomous underwater vehicle (AUV), enabling the AUV to secure itself to the seabed, ascend and descend via the tether, transmit and receive signals from the tether, and retract the tether and anchor to release itself from the seabed and execute the anchoring sequence again as required.

Small, lightweight AUVs operating near the seabed for extended periods of time can benefit from the ability to secure themselves to the seabed or lakebed. Anchoring can allow an AUV to remain on the bottom, or at various depths, without expending electrical or mechanical energy to keep station while resisting the forces of currents, tides and wave action. This may be especially helpful in littoral or shallow environments where wave action is more severe. The typical state of rest for a deployed AUV ranges from passive floating on the surface of the water or at various depths (in some cases gliding) to resting freely on the sea floor. Traditional methods of anchoring rely on the weight of the anchor and anchor chain, along with the rigid projections of the anchor itself, to drag along the seabed, increasing friction and resisting the movement of the vessel.

Recent concepts and implementations of anchoring systems for underwater vehicles include the use of a bottom crawler, which is carried on the bottom of an AUV and delivered to the seabed by the AUV. [Ref.1] Once on the seabed, the AUV detaches from the bottom crawler but remains connected by a cable. Upon completion of the mission, the AUV is winched back to the crawler, re-attaches itself, and proceeds to a new location. Another recent prototype, described as a self-mooring AUV, uses a compressed gas to jettison an anchor, in the form of a nosecone, attached to a torpedo-shaped AUV by a vacuum seal. [Ref.2] The weight of the anchor drags the AUV down vertically by a mooring line until the anchor rests on the seabed. The AUV later detaches from the mooring line via galvanic release and continues its mission.

Embodiments in accordance with this disclosure relate to a resetting, combination anchor, antenna and tether mechanism for an autonomous underwater vehicle.

INCORPORATION BY REFERENCE

The following publications are incorporated by reference in their entirety.

[Ref.1] Rosloff, J. P. A one-armed anchor of c. 400 BCE from the Ma'agan Michael vessel, Israel. A preliminary report. *Int. J. Naut. Archaeol.* 1991, 20, 223-226.

[Ref.2] Bird, C. E.; Franklin, E. C.; Smith, C. M.; Toonen, R. J. Between tide and wave marks: A unifying model of physical zonation on littoral shores. *PeerJ* 2013, 1, e154.

[Ref.3] Williams, D. L. *Loitering Behaviors of Autonomous Underwater Vehicles*; Technical Report; Naval Postgraduate School: Monterey, CA, USA, 2002.

[Ref.4] Eldred, R.; Lussier, J.; Pollman, A. Design and Testing of a Spherical Autonomous Underwater Vehicle for Shipwreck Interior Exploration. *J. Mar. Sci. Eng.* 2021, 9, 320.

[Ref.5] Richmond, K.; Gulati, S.; Flesher, C.; Hogan, B. P.; Stone, W. C. Navigation, control, and recovery of the ENDURANCE under-ice hovering AUV. In Proceedings of the 16th Annual International Symposium on Unmanned Untethered Submersible Technology (UUST), Durham, NH, USA, 23-26 Aug. 2009.

[Ref.6] Gary, M.; Fairfield, N.; Stone, W. C.; Wettergreen, D.; Kantor, G.; Sharp, J. M., Jr. 3D mapping and characterization of Sistema Zacatón from DEPTHX (DE ep P hreatic TH ermal e X plorer). In *Sinkholes and the Engineering and Environmental Impacts of Karst*; American Society of Civil Engineers (ASCE): Reston, VA, USA, 2008; pp. 202-212.

[Ref.7] Milosevic, Z.; Fernandez, R. A. S.; Dominguez, S.; Rossi, C. Guidance for Autonomous Underwater Vehicles in Confined Semistructured Environments. *Sensors* 2020, 20, 7237.

[Ref.8] Hinz, E. R. *The Complete Book of Anchoring and Mooring*; Cornell Maritime Press/Tidewater Publishers: Centreville, VA, USA, 1994.

[Ref.9] Rousmaniere, J. *The Annapolis Book of Seamanship: Completely Revised, Expanded and Updated*; Simon and Schuster: New York, NY, USA, 1999.

[Ref.10] House, D. *Ship Handling*; Routledge: London, U K, 2007.

[Ref.11] Pyo, J.; Yu, S. C.; Park, J. C.; Park, S. C. Development of a robotic anchoring system for underwater vehicle under water current. In Proceedings of the 2012 Oceans, Yeosu, Korea, 21-24 May 2012; pp. 1-5.

[Ref.12] McCarter, B.; Briggs, R.; Portner, S.; Stilwell, D.; Neu, W.; Coe, R.; Duelley, R.; Malley, D.; Mims, J. Design and testing of a self-mooring AUV. In Proceedings of the 2012 Oceans, Hampton Roads, VA, USA, 14-19 Oct. 2012; pp. 1-8.

[Ref.13] Bin-Karim, S.; Muglia, M.; Mazzoleni, A.; Vermillion, C. Control of a relocatable energy-harvesting autonomous underwater vehicle in a spatiotemporally-varying gulf stream resource. In Proceedings of the 2018 Annual American Control Conference (ACC), Milwaukee, WI, USA, 27-29 Jun. 2018; pp. 2575-2580.

[Ref.14] Tandon, S.; Divi, S.; Muglia, M.; Vermillion, C.; Mazzoleni, A. Modeling and dynamic analysis of a mobile underwater turbine system for harvesting marine hydrokinetic energy. *Ocean. Eng.* 2019, 187, 106069.

[Ref.15] Bin-Karim, S.; Muglia, M.; Vermillion, C. Centralized position optimization of multiple agents in spatiotemporally-varying environment: A case study with relocatable energy-harvesting autonomous underwater vehicles in the gulf stream. In Proceedings of the 2019 IEEE Conference on Control Technology and Applications (CCTA), Hong Kong, China, 19-21 Aug. 2019; pp. 264-269.

[Ref.16] Reed, J.; Daniels, J.; Siddiqui, A.; Cobb, M.; Vermillion, C. Optimal exploration and charging for an autonomous underwater vehicle with energy-harvesting kite. In Proceedings of the 2020 American Control Conference (ACC), Denver, CO, USA, 1-3 Jul. 2020; pp. 4134-4139.

[Ref.17] Brizard, T. Jet-pump-based autonomous underwater vehicle and method for coupling to ocean bottom during marine seismic survey. U.S. Pat. No. 9,381,986B2, 5 Jul. 2016.

[Ref.18] Zheng, M.; Wang, L.; Stoner, R.; Coates, R. Underwater digital communication utilising parametric sonar with M-ary DPSK modulation. *IEE Proc. Radar Sonar Navig.* 1999, 146, 213-218.

[Ref.19] Yusof, M. A. B.; Kabir, S. An overview of sonar and electromagnetic waves for underwater communication. *IETE Tech. Rev.* 2012, 29, 307-317.

[Ref.20] Li, Y.; Yin, H.; Ji, X.; Wu, B. Design and implementation of underwater wireless optical communication system with high-speed and full-duplex using blue/green light. In Proceedings of the 10th International Conference on Communication Software and Networks (ICCSN), Chengdu, China, 6-9 Jul. 2018; pp. 99-103.

[Ref.21] Gough, P. T.; Hawkins, D. W. A short history of synthetic aperture sonar. In Proceedings of the IGARSS'98. Sensing and Managing the Environment. 1998 IEEE International Geoscience and Remote Sensing. Symposium Proceedings. (Cat. No. 98CH36174), Seattle, WA, USA, 6-10 Jul. 1998; Volume 2, pp. 618-620.

[Ref.22] Wiener, T.; Karp, S. The role of blue/green laser systems in strategic submarine communications. *IEEE Trans. Commun.* 1980, 28, 1602-1607.

[Ref.23] Wang, M.; Yuan, X.; AlHarbi, O.; Deng, P.; Kane, T. Propagation of laser beams through air-sea turbulence channels. In *Laser Communication and Propagation through the Atmosphere and Oceans VII: Proceedings of the SPIE Optical Engineering and Applications*, San Diego, CA, USA, 19-23 August 2018; International Society for Optics and Photonics: Bellingham, *WA, USA,* 2018; Volume 10770, p. 1077003.

[Ref.24] Inácio, S. I.; Pereira, M. R.; Santos, H. M.; Pessoa, L. M.; Teixeira, F. B.; Lopes, M. J.; Aboderin, O.; Salgado, H. Antenna design for underwater radio communications. In Proceedings of the Oceans 2016, Shanghai, China, 10-13 Apr. 2016; pp. 1-6.

[Ref.25] Kelley, B.; Naishadham, K. RF multicarrier signaling and antenna systems for low SNR broadband underwater communications. In Proceedings of the IEEE Topical Conference on Power Amplifiers for Wireless and Radio Applications, Austin, TX, USA, 20-23 Jan. 2013; pp. 169-171.

[Ref.26] Smolyaninov, I.; Balzano, Q.; Young, D. Development of broadband underwater radio communication for application in unmanned underwater vehicles. *J. Mar. Sci. Eng.* 2020, 8, 370.

[Ref.27] Rogers, R. L.; Buhl, D. P. *Clandestine ELOS/OTH RF Communications for Unmanned Underwater Vehicles*; Technical Report; Applied Research Laboratories, University of Texas: Austin, TX, USA, 2002.

[Ref.28] Aboderin, O.; Pessoa, L. M.; Salgado, H. M. Performance evaluation of antennas for underwater applications. In Proceedings of the Wireless Days, Porto, Portugal, 29-31 Mar. 2017; pp. 194-197.

[Ref.29] Fessenden, C.; Cheng, D. Development of a trailing-wire E-field submarine antenna for extremely low frequency (ELF) reception. *IEEE Trans. Commun.* 1974, 22, 428-437.

[Ref.30] Palmeiro, A.; Martin, M.; Crowther, I.; Rhodes, M. Underwater radio frequency communications. In Proceedings of the Oceans 2011 IEEE, Santander, Spain, 6-9 June 2011; pp. 1-8.

[Ref.31] Potter, J.; Alves, J.; Green, D.; Zappa, G.; Nissen, I.; McCoy, K. The JANUS underwater communications standard. In Proceedings of the 2014 Underwater Communications and Networking (UComms), Sestri Levante, Italy, 3-5 Sep. 2014; pp. 1-4.

[Ref.32] Alves, J.; Furfaro, T.; LePage, K.; Munafó, A.; Pelekanakis, K.; Petroccia, R.; Zappa, G. Moving JANUS forward: A look into the future of underwater communications interoperability. In Proceedings of the Oceans 2016 MTS/IEEE, Monterey, CA, USA, 19-23 September 2016; pp. 1-6.

[Ref.33] Xie, P.; Zhou, Z.; Peng, Z.; Cui, J. H.; Shi, Z. SDRT: A reliable data transport protocol for underwater sensor networks. *Ad Hoc Netw.* 2010, 8, 708-722.

[Ref.34] Luo, Y.; Pu, L.; Peng, Z.; Zhou, Z.; Cui, J. H. CT-MAC: A MAC protocol for underwater MIMO based network uplink communications. In Proceedings of the Seventh ACM International Conference on Underwater Networks and Systems, Los Angeles, CA, USA, 5-6 Nov. 2012; pp. 1-8.

[Ref.35] Akyildiz, I. F.; Pompili, D.; Melodia, T. State-of-the-art in protocol research for underwater acoustic sensor networks. In Proceedings of the 1st ACM International Workshop on Underwater Networks, Los Angeles, CA, USA, 25 Sep. 2006; pp. 7-16.

[Ref.36] Yoon, S.; Azad, A. K.; Oh, H.; Kim, S. AURP: An AUV-aided underwater routing protocol for underwater acoustic sensor networks. *Sensors* 2012, 12, 1827-1845.

[Ref.37] Assallay, A.; Rogers, C.; Smalley, I.; Jefferson, I. Silt: 2-62 μm, 9-4ϕ. *Earth-Sci. Rev.* 1998, 45, 61-88.

[Ref.38] Guggenheim, S.; Martin, R. Definition of clay and clay mineral: Joint report of the AIPEA nomenclature and CMS nomenclature committees. *Clays Clay Miner.* 1995, 43, 255-256.

[Ref.39] Eldred, R.; Van Bossuyt, D. L. Preliminary Design and Testing of a Resetting Combination Anchor, Antenna, and Tether Mechanism for a Spherical Autonomous Underwater Vehicle. Appl. Sci. 2022, 12, 5072.

BRIEF DESCRIPTION

In accordance with one embodiment of the present disclosure, disclosed is a an underwater vehicle comprising: a hull; a propulsion system operatively associated with propulsion of the hull; an electrical energy storage system; an anchoring system; and at least one controller operatively powered by the electrical energy storage system, and the controller operatively associated with controlling the propulsion system and the anchoring system, the anchoring system including: a tether joined to a spool at a first end and an anchor at a second end, wherein the tether is retained by the spool and retracted by a first electronic actuator, and the anchor includes an internally stowed metallic auger passing through an anchor plug located on an external surface of the hull, the anchor includes an array of wire bristles retained by a ring, and the anchor is driven by a second electronic actuator operatively associated with driving an anchor cap operatively engaging the anchor; and a frame including a bracket retaining the spool, a cylinder interfacing with internal and external gear couplings driven by the second electronic actuator, and a spring retained by a cylinder cap, wherein the internal and external gear couplings driven by the second electronic actuator, and the spring operate to eject the anchor from the hull and retract the anchor into the hull from an ejected position.

In accordance with another embodiment of the present disclosure, disclosed is a method for deploying an underwater vehicle comprising: stowing an anchor assembly within an anchor sleeve of the underwater vehicle; while the underwater vehicle is descending to a seabed, extending an anchor spike of the anchor assembly to protrude from the underwater vehicle; after the underwater vehicle contacts the seabed, using an anchor driving system housed within the underwater vehicle to mechanically rotate the anchor spike deeper into the seabed while applying counter-yaw propulsion to the underwater vehicle; the underwater vehicle applying upward propulsion thrust to disconnect the underwater vehicle from the anchor while retaining a tethered connection to the anchor assembly, and positioning the underwater vehicle at a target tether length from the anchor assembly; a transceiver, operatively connected to the tether, receiving an electromagnetic signal from an external source that corresponds to the target tether length; and the underwater vehicle retracting the tether to reattach the underwater vehicle to the anchor assembly.

In accordance with another embodiment of the present disclosure, disclosed is an underwater vehicle anchoring mechanism comprising: a tether joined to a spool serving as a transceiver connection at a first end and an anchor assembly at a second end, wherein the tether is retained by the spool and retracted by an electronic actuator; the anchor assembly including an internally-stowed anchor including a metallic auger passing through a plug externally fixed to a hull of an associated underwater vehicle, wherein the anchor is driven by an anchor cap coupler housed within the associated underwater vehicle and the anchor assembly includes an array of longitudinally extended wire bristles retained by a ring; and a frame including a bracket retaining the spool, and a cylinder including an interface with internal and external gear couplings to drive the anchor assembly, and the cylinder including a spring retained by a cap, wherein the spring exerts downward pressure on the anchor assembly, at least in part, for driving the anchor into a seabed.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

For a more complete understanding of the present disclosure, reference is now made to the following descriptions taken in conjunction with the accompanying drawings.

FIG. 16 shows Table A1. Test 1: complete anchoring failure tension data (Ibf).

FIG. 17 shows Table A2. Test 2: complete anchoring failure tension data (Ibf).

FIG. 18 shows Table A3. Test 3: complete anchoring failure tension data (Ibf).

FIG. 19 shows Table A4. Test 4: complete anchoring failure tension data (Ibf).

FIG. 20 shows Table A5. Test 5: complete anchoring failure tension data (Ibf).

DETAILED DESCRIPTION

Figure 1:
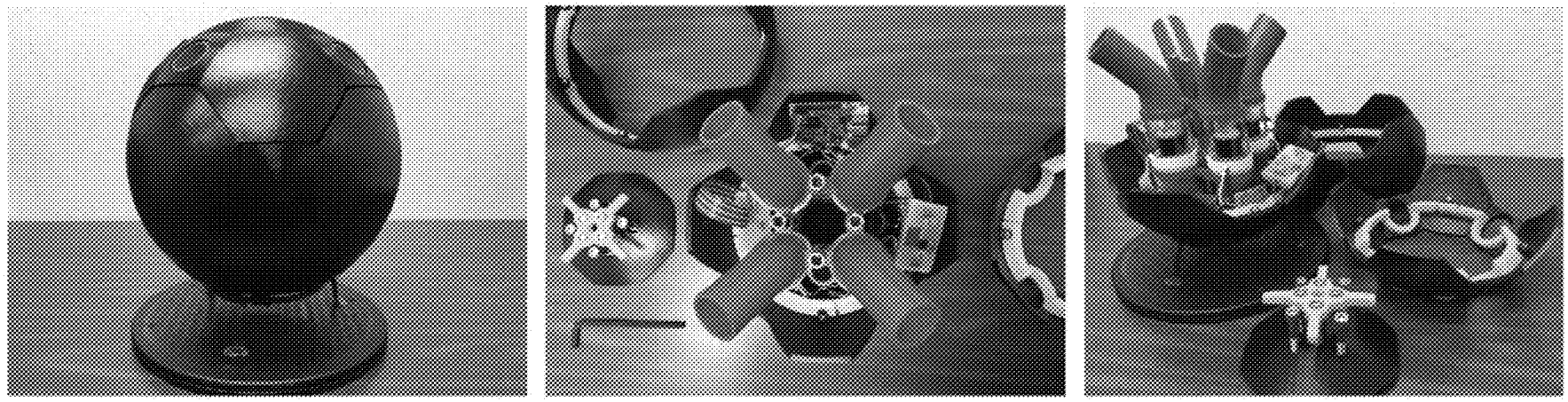
FIG. 1 shows The first Wreck Interior Exploration Vehicle (WIEVLE) prototype: (a) WIEVLE on its test stand; (b) A top down view of the internal propulsion system. Note the central cavity where the RAATM may be installed; (c) WIEVLE's spherical hull disassembled to reveal the internal propulsion core.

This disclosure and exemplary embodiments described herein provide an anchor system, method, and mechanism for an underwater vehicle. The implementation described herein is related to an autonomous underwater vehicle anchoring system, method, and mechanism, including the incorporation of an antenna type communication system, however it is to be understood that the scope of this disclosure is not limited to such application.

The present disclosure, and exemplary embodiments provided herein, is specifically directed to a resetting, anchor and tether mechanism, which may also serve as an antenna, for an autonomous underwater vehicle (AUV), enabling the AUV to secure itself to the seabed, ascend and descend via the tether, transmit and receive signals from the tether, and retract the tether and anchor to release itself from the seabed and execute the anchoring sequence again as required.

In addition to an exemplary system, method and mechanism, analysis and testing results of prototype components, as well as how these components perform in relation to holding power in various sediments.

The description below provides exemplary embodiments of the present disclosure. The scope of the present disclosure is not limited by these exemplary embodiments. Numerous variations, whether explicitly provided for by the specification or implied by the specification or not, may be implemented by one of skill in the art in view of this disclosure.

The following abbreviations are used in this disclosure:

ANOVA Analysis of Variance
AUV Autonomous Underwater Vehicle
C2 Command and Control
CPT Central Payload Tube
ELF Extremely Low Frequency
ISR Intelligence Surveillance and Reconnaissance
NATO North Atlantic Treaty Organization
RAATM Resetting Anchor/Antenna Tether Mechanism
RF Radio Frequency
SAUV Spherical Autonomous Underwater Vehicle
UUV Unmanned Underwater Vehicle
WIEVLE Wreck Interior Exploration Vehicle Specifically, this disclosure details the design and testing of a Resetting Anchor/Antenna Tether Mechanism (RAATM) for an autonomous underwater vehicle (AUV). The disclosed mechanism is intended to enable an AUV to secure itself to the seabed, ascend, descend, transmit and receive signals via the tether, retract the anchor, and re-anchor again as required. The ability of an AUV to passively loiter on station for extended periods preserves power and may otherwise expand mission capabilities for a variety of underwater vehicles. If they are capable of communication through electromagnetic transmission, AUVs equipped with such technology may be utilized to form mobile networks that may, in turn, receive external communications from above the surface. Spherical AUV (SAUV) capabilities may be especially enhanced through the integration of the proposed mechanism. The RAATM was designed for integration with the Wreck Interior Exploration Vehicle (WIEVLE), a small SAUV designed for operations in entanglement-prone, extreme environments, but the RAATM may be used in any suitably-sized underwater vehicle capable of safely contacting the ocean floor. A prototype of the anchoring portion of the mechanism was constructed, and anchoring strength was tested repeatedly in three types of sediment, under varied configurations and loading angles, with promising results.

Resetting Anchor/Antenna Tether Mechanism (RAATM) is a device designed to provide dual anchoring and antenna capabilities to autonomous underwater vehicles (AUVs). The RAATM is resettable; an AUV can anchor at one location for a period of time, retrieve the anchor, move to a new location, and redeploy the anchor. Furthermore, the RAATM tether may also be used as an antenna for radio communications while deployed; this may allow smaller AUVs to accomplish missions that would otherwise require larger AUVs with dedicated antennas. While resettable anchors have been available for vessels for thousands of years [Ref.1], the RAATM has a unique design that is appropriate for small AUVs operating in dynamic conditions in littoral zones, coastal areas, riverine environments, and other bodies of water. The RAATM design combines an augering anchor spike with a sliding array of semi-flexible wire roots with friction-enhancing bristles embedded around the base of the anchor assembly.

Small, lightweight AUVs operating near the seabed for extended periods of time may benefit from the ability to secure themselves to the seabed. Anchoring may allow an AUV to remain on the bottom, or at various depths, without expending electrical or mechanical energy to keep station while resisting the forces of currents, tides, and wave action. This may be especially helpful in littoral or shallow environments where wave action is more severe [Ref.2]. The typical state of rest for a deployed AUV ranges from passively floating on the surface of the water or at various depths (in some cases gliding) to resting freely on the sea floor [Ref.3].

Most traditional methods of anchoring rely on the weight of the anchor and the portion of the anchor rode (the rope, chain, cable, or combination thereof that connects the anchor to the vessel) that lies on the seabed, along with the rigid projections of the anchor itself, to drag along the seabed, increasing friction and thereby resisting the movement of the vessel. Some anchoring methods use an auger to screw into the seafloor for small, lightweight applications. To the Inventor's knowledge, no existing anchoring methods combine an auger with an array of wire roots that can reset between deployments for multiple anchoring operations throughout an AUV mission.

Of particular interest is the RAATM integration with the Wreck Interior Exploration Vehicle (WIEVLE) AUV [Ref.4]. The WIEVLE is a spherical AUV designed to operate in highly complex environments such as littoral zones, inside shipwrecks, and other environments with a high risk of entanglement. To maximize utility in a variety of mission capacities that require a long loitering time in a specific operating area, an anchor system is sought. Furthermore, periodic communication between the WIEVLE and command and control (C2) infrastructure would expand mission capability while loitering in a given operating area. Thus, the RAATM may be useful to expand the range of missions that the WIEVLE and similar AUVs can perform successfully.

2. Background and Related Work

2.1. Spherical Autonomous Underwater Vehicles

The spherical autonomous underwater vehicle (SAUV) is a particularly interesting architecture alternative for an underwater vehicle that must operate within entanglement-prone, complex environments such as confined spaces and littoral environments. Multiple SAUVs have been designed in recent years for such missions, including some that are highly advanced [Refs.5-7]. Two key benefits to a spherical hull profile are the reduction or elimination of external protuberances that can aggravate snagging and the fact that a spherical vehicle occupies the same volume of space as it rotates, making maneuvers easier in tight quarters. The WIEVLE was developed with these principles at the forefront while also seeking to minimize sediment disruption via a novel, quad-core, internal tunnel-thruster propulsion system that draws water from below the sphere and ejects the wash upward, at an angle, symmetrically, around the vertical axis. The original WIEVLE prototype, which presently lacks an anchoring mechanism, is depicted in FIG. 1.

Other highly advanced SAUVs, such as the ENDURANCE [Ref.5], DEPTHX [Ref.6], and UX-1 [Ref.7], lack anchoring mechanisms because they are designed to return to the point of entry upon completion of their missions and are not intended to loiter for extended periods on station. A solution to enable an SAUV to passively remain on station for extended periods, rather than simply allowing the vehicle to drift or roll on the seabed and risk damage, is therefore desired. Although the anchoring system disclosed herein may be used within any shape or style of AUV of appropriate size, the exemplary embodiment described focuses on its application for spherical (or spheroid) hull profiles, as the operational capabilities offered by SAUVs may be particularly enhanced by the integration of such a mechanism. Furthermore, it is contended that current UUV anchoring mechanisms are either unsuitable for implementation in an SAUV due to their negative impact upon the smooth profile of the hull exterior, or they are non-resetting, single-use mechanisms.

2.2. Anchoring Systems

Methods of anchoring vessels have existed for thousands of years [Ref.1]. Typically, anchors either dig into the seabed (such as hook anchors, bruce anchors, etc.), have sufficient mass to stay in one place on the seabed (such as those used with moorings for larger vessels and anchors for very small vessels), or screw into or are otherwise affixed to the seabed [Ref.8]. In most cases, rode made of chain, rope, cable, or a combination of materials attaches the anchor to the vessel [Ref.9]. In many cases, the anchor uses a length of rode at least the length of the vessel, made of chain that lays on the ocean floor to increase the anchor's ability to hold fast [Ref. 10]. All of the above techniques can be used by AUVs, but the implementation depends upon a variety of factors, such as the carrying capacity of the AUV.

Recent concepts and implementations of anchoring systems for underwater vehicles include the use of a bottom crawler, which is carried on the bottom of an AUV and delivered to the seabed by the AUV [Ref.11]. Once on the seabed, the AUV detaches from the bottom crawler but remains connected by a cable. Upon completion of the mission, the AUV is winched back to the crawler, re-attaches itself, and proceeds to a new location. Another recent prototype, described as a self-mooring AUV, uses compressed gas to jettison an anchor, in the form of a nosecone, attached to a torpedo-shaped AUV by a vacuum seal [Ref.12]. The weight of the anchor drags the AUV down vertically by a mooring line until the anchor rests on the seabed. The AUV later detaches from the mooring line via galvanic release and continues its mission. Other recent works [Refs.13-16] have described potential uses, such as harvesting the energy of currents using an organic kite-based generator, for AUVs that can anchor temporarily to the seabed. Another design describes a vehicle that uses jet pumps to cause an AUV to penetrate the seabed for seismic sensing [Ref.17].

2.3. Underwater Communications

The ability to transmit data is necessary for certain AUV missions. In many cases, a command and control entity may want to provide additional instructions to an AUV based on what the AUV has sensed in the environment. Facilitating this command and control requires two-way communications, including while the AUV is submerged. Existing technologies rely on sonar [Ref.18], radio frequency (RF) [Ref.19], and blue-green lasers to communicate [Ref.20]. Sonar uses pulses of sound to propagate through water as waves, is relatively slow compared to blue-green lasers and RF [Refs.20,21], and can dissipate rapidly or be impeded by underwater structures. Radio waves propagate via electromagnetic fields and can pass through almost any matter or in a vacuum, but they are significantly attenuated at most frequencies by water, which limits their effective C2 range and bit-rate [Ref.19]. While sonar and RF C2 links have been deployed for some time, and blue-green lasers have been proposed and demonstrated for many decades [Ref.22], blue-green lasers are relatively new to underwater applications and have not been widely fielded. Furthermore, unlike Extremely Low Frequency (ELF) antenna transmissions, blue-green lasers require a surface or airborne asset (often a satellite) to enable communications back to shore [Ref.23].

In spite of the limitations of RF transmission underwater, it is sometimes the preferred form of communication with the surface and other underwater assets, and it is the proposed communication method for the WIEVLE [Ref.4]. Many different antenna designs have been proposed and implemented for underwater C2 links [Refs.24-26]. Antennas that can deploy and be retracted have been proposed and implemented for a variety of purposes [Ref.27]. To enable the WIEVLE and other AUVs that operate passively for extended periods in a given space to communicate as a mobile network and receive external signals via RF link, an antenna that can be autonomously stowed and deployed is desired. Fixed antennas external to the WIEVLE hull would interfere with the ability to maneuver in locations with a high risk of entanglement. An internal antenna may interfere with onboard electronics and intelligence, surveillance, and reconnaissance (ISR) sensors, have undesirable transmission characteristics, and take up valuable space that could be used for other critical components within its relatively small profile. Thus, it is desirable to integrate the WIEVLE's antenna with an anchor system.

Underwater radio C2 links can operate at various frequencies and power levels based on the required bandwidth and transmission distance. Various antenna types, such as dipoles, j-poles, and loops, have been used [Ref.28] from high frequencies (3-30 MHz) to low frequencies-especially extremely low frequencies in the 3-30 Hz range, using long monopole antennas (sometimes many kilometers long) that are constructed out of a conducting material that can be unrolled and trailed behind a moving AUV [Ref.29]. Higher frequencies transmit at shorter distances underwater but often have higher data throughput capabilities [Ref.30]. Higher-power transmissions can propagate farther, although in small AUVs, the additional power consumption may be too high for the system to support the load.

A variety of protocols have been developed specifically for underwater data transmission to handle low-bandwidth and high-interference environments. The JANUS protocol was developed by NATO and is available for anyone to use [Ref.31]. It primarily operates on sonar (acoustic) C2 links [Ref.32]. Other protocols, such as the SDRT, have been developed for underwater sensor networks [Ref.33]. Many more proposed protocols exist in the literature, with many focusing on sonar C2 links, but some using RF C2 links [Ref.34-36]. Only protocols designed to work via RF transmission are applicable to the proposed RAATM integrated antenna.

3. Materials and Methods

3.1. Overview

The RAATM is designed to enable a small, lightweight AUV (and specifically the WIEVLE) to secure itself temporarily to the seabed, change depth by paying out and retracting the tether via an internal spool, transmit and receive electromagnetic signals over short distances, re-stow the anchor, and maneuver to another area to repeat the process as required. The mechanism is ideally suited to lightweight vehicles that need to maintain a smooth exterior to reduce drag or entanglement hazards, thus precluding traditional, heavy, external anchoring systems. The key design requirements, therefore, are minimal weight, internal stowability, reusability, and the ability to pay out varying lengths of tether and, thus, change depth without the aid of propulsive thrusters or active buoyancy compensation. The principal means of attachment to the seabed, which presumably consists of sediment, sand, or fine gravel in the operating area, is an anchor "spike", in the form of an auger, aided by an array of semi-flexible wire "roots" embedded with friction-enhancing bristles surrounding the base of the anchor assembly in a shallow pattern.

The use of a screw-type anchor spike as a principal method of anchoring to the seabed proceeded naturally from the design requirements based on the intended host platform (the SAUV WIEVLE). The chief concern, however, for the use of the anchor spike alone was the risk of failure due to the anchor spike working loose from the sediment due to insufficient gripping strength or the inability to resist angled loads on the tether. A method of enhancing the design's gripping strength while fitting within the physical boundary constraints of a cylinder (the central space along the WIEVLE's vertical axis) was sought, and inspiration was taken from the method employed by sea grass to anchor in sand and resist continuously-varying tension loads from wave action-fine roots spread out over a wide surface area. Alternative designs, such as screw-type rigid or semi-flexible "roots" or expanding rigid mechanisms, such as those used to augment certain drywall anchors, were considered but ultimately abandoned due to the complexity of generating the necessary rotation in the case of screw-type anchor branches or the high probability of jamming in the case of folding rigid mechanisms. In both alternatives, a successful deployment seemed likely to be followed by a failed retraction; thus, a simple method of push-pull insertion and retraction was desired to satisfy the reusability requirement.

Figure 2:
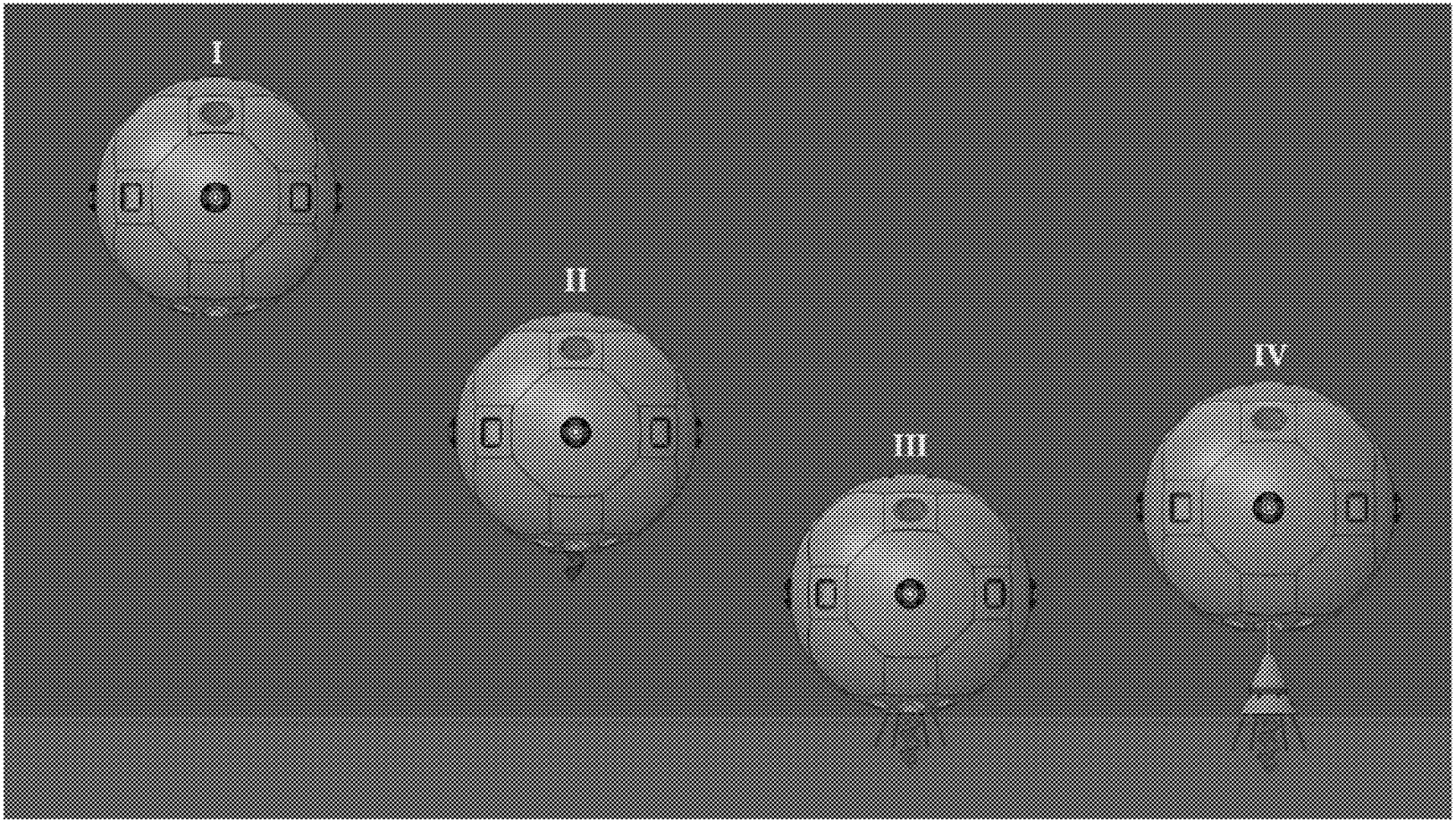
FIG. 2 shows The RAATM, installed within the WIEVLE, executing the anchoring sequence from the stowed to the tethered positions.

The resulting mechanism operates through four states (I-IV), as depicted in FIG. 2: (I) the stowed position, (II) the inject position, (III) the rooted position, and (IV) the tethered position. The principal assemblies of the mechanism include the spool and tether assembly, the anchor sleeve assembly, and the retractable anchor assembly, described in detail in Section 3.2.

3.2. Components

Figure 3A:
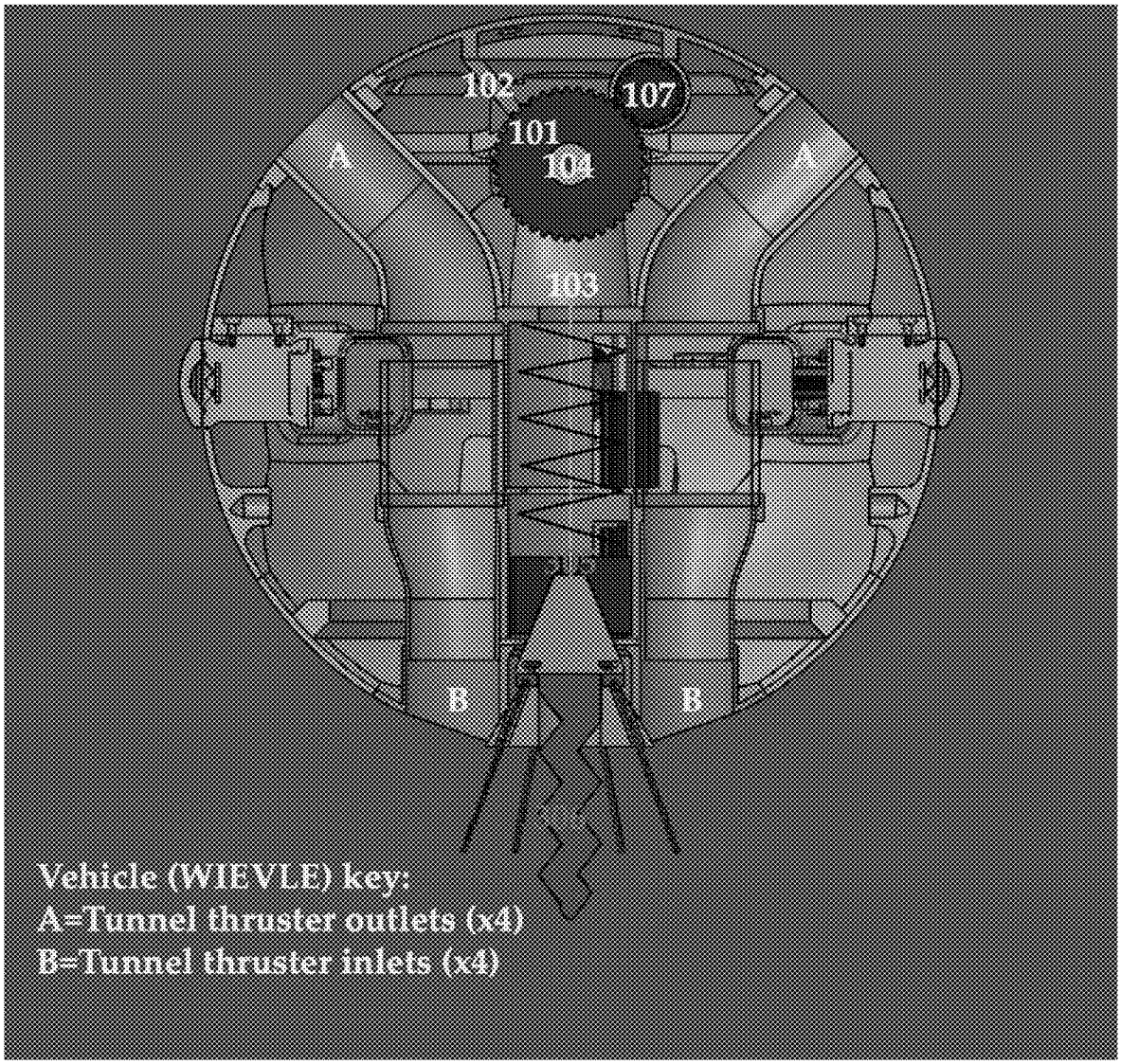
FIGS. 3A and 3B show RAATM spool and tether assembly components: (a) RAATM spool and tether assembly components in the rooted position within the WIEVLE; (b) RAATM spool and tether assembly components in the rooted (left) and stowed (right) positions.
Figure 3B:
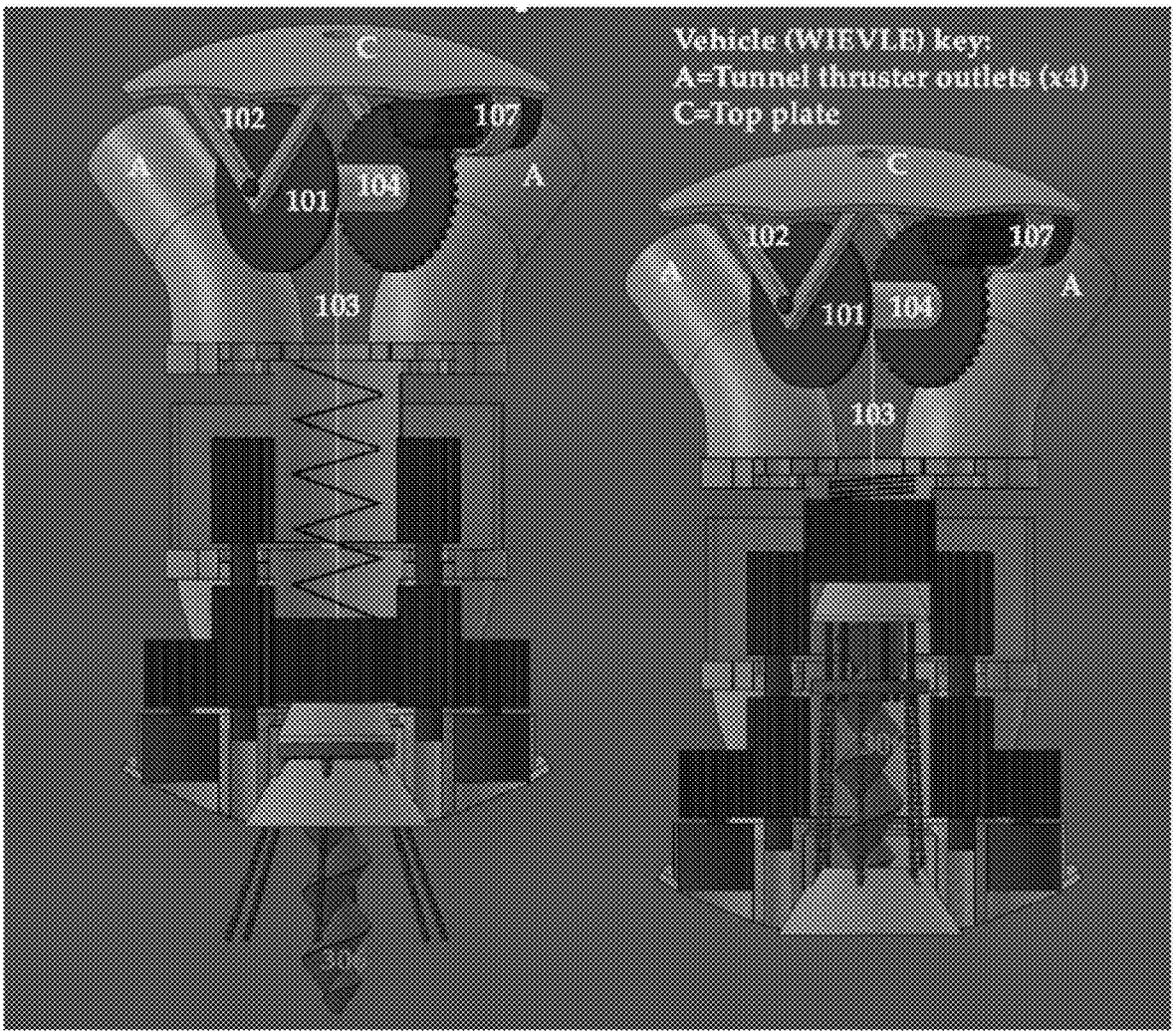

In the following sub-sections, the specific components referenced in the text are numbered for ease of cross-reference with the associated figures, with capital letters denoting vehicle-specific components for reference, 100 series reference characters/numbers denoting spool and tether assembly components, 200 series reference characters/numbers denoting anchor sleeve assembly components, and 300 series reference characters/numbers denoting anchor assembly components. Note that the RAATM was intended to be integrated within a small, spherical AUV, such as the WIEVLE, but could potentially be implemented on a variety of AUVs. In the WIEVLE, the RAATM would be contained within the space aligned vertically with the central axis, also known as the Central Payload Tube (CPT) [Ref.4]. In other underwater vehicles, one or more RAATMs may be incorporated in a similar manner such that the configuration enables the anchor port(s) to directly contact the seabed. The spool and tether assembly components are depicted in FIG. 3 and labeled with 100 series reference characters/numbers.

Figure 4:
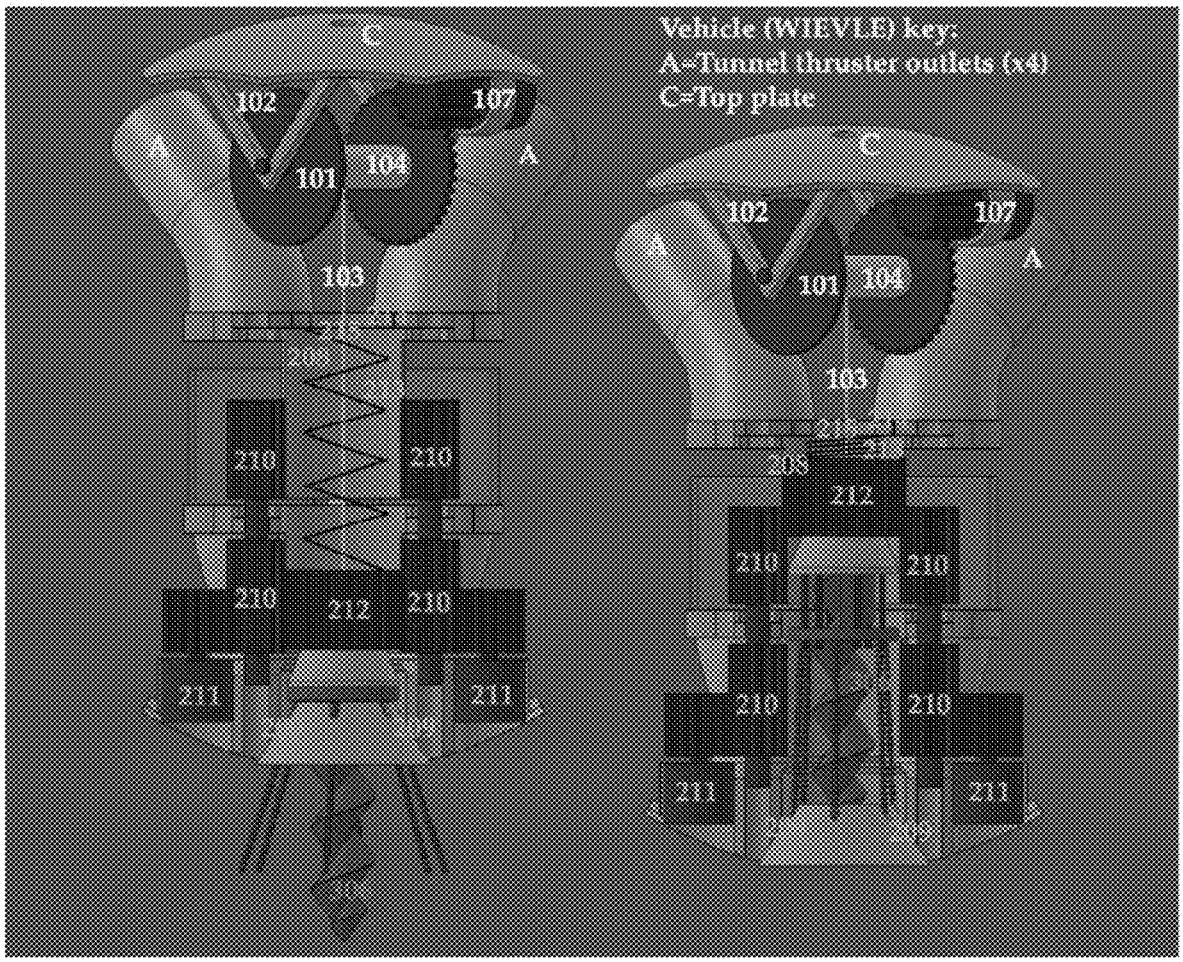
FIG. 4 shows RAATM anchor sleeve assembly components in the rooted (left) and the stowed (right) positions.

The tether spool (101) is mounted at the top of the mechanism by brackets (102). The tether (103) is connected at one end to the spindle (104), upon which it is wound and through which electromagnetic signals may be sent or received; the tether is connected at the other end to the swivel eyelet (305) at the top of the anchor spike (306). The tether thickness may vary depending on the vehicle's size, but it should be thin yet strong enough to hold the AUV against anticipated currents. Since the tether also serves as an electromagnetic antenna, the tether and spindle should be made of an appropriately conductive material, and the tether, when deployed, should be extended to a suitable length corresponding to the intended wavelength of the electromagnetic signal to allow signal transmission and reception via the vehicle's onboard transceiver. Torque is transmitted to the tether spool via one or more electric actuators (107), rotating the spindle to extend or retract the tether. The anchor sleeve assembly components are depicted in FIG. 4 and labeled with 200 series reference characters/numbers.

The anchor sleeve (208) is a cylindrical tube positioned below the tether spool (101) that contains the deployable anchor assembly. It consists of a fixed cylindrical tube joined to a beveled, notched anchor port (209) at the base of the hull. The anchor port retains the anchor plug by permanent magnetic inserts in the base of the anchor plug and the anchor port walls. The cylinder extends upward, terminating just below the tether spool (101), and it contains vertical slots that enable the interfacing of corresponding vertical spur gears (210), driven by electric actuators (211) adjacent to the anchor plug, extending upward and engaging with the corresponding outer splines of the anchor cap coupler (212)—a vertically-splined, externally cylindrical and internally conical (concave) spur gear. The anchor cap coupler is compressed by the anchor spring (213) onto a corresponding (convex) conical spur gear that serves as the anchor cap. The anchor cap coupler has a small, beveled, central guide hole allowing the swivel eyelet (305) to insert and the tether (103) to pass through. The anchor spring (213) glides smoothly within a groove at the top of the anchor cap coupler (212) to allow the anchor cap coupler to rotate freely inside the anchor sleeve (208). The anchor sleeve cap (214) is fixed at the top of the anchor sleeve (208) and retains the anchor spring (213) to enable compression. The anchor sleeve cap (214) contains a central guide hole (215), reinforced with a Teflon insert, to resist abrasion from the tether and damage to the tether, reduce friction, and center the tether onto the tether spool (101). The tether spool incorporates a latching mechanism to relieve tension from the spindle actuator (107) in the fully retracted, stowed position.

Figure 5:
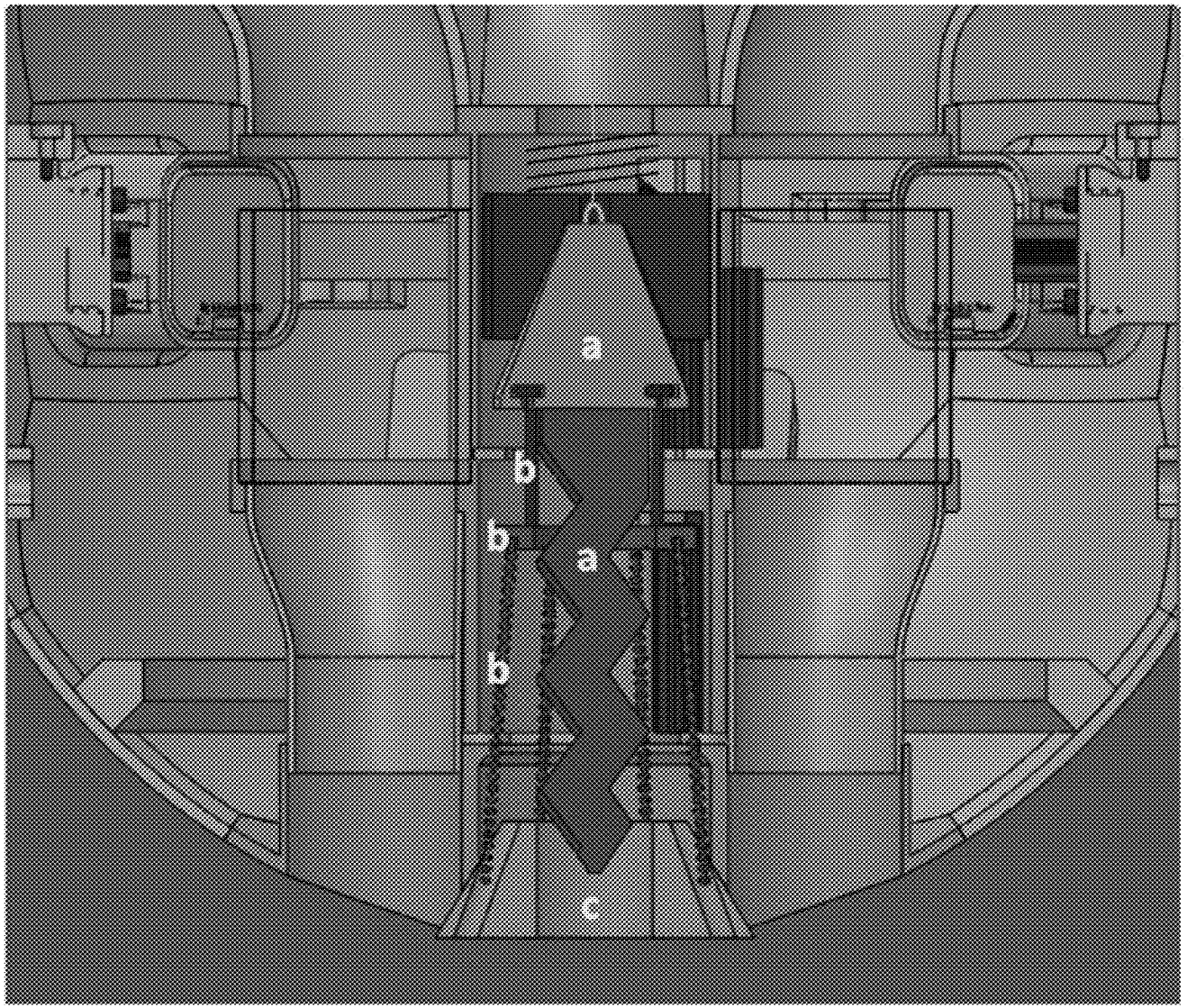
FIG. 5 shows RAATM anchor sub-assemblies in the stowed position.

The anchor assembly consists of three sub-assemblies (a-c) as depicted in FIG. 5: (a) the anchor spike sub-assembly, (b) the wire root array sub-assembly, and (c) the anchor plug sub-assembly.

Figure 6:
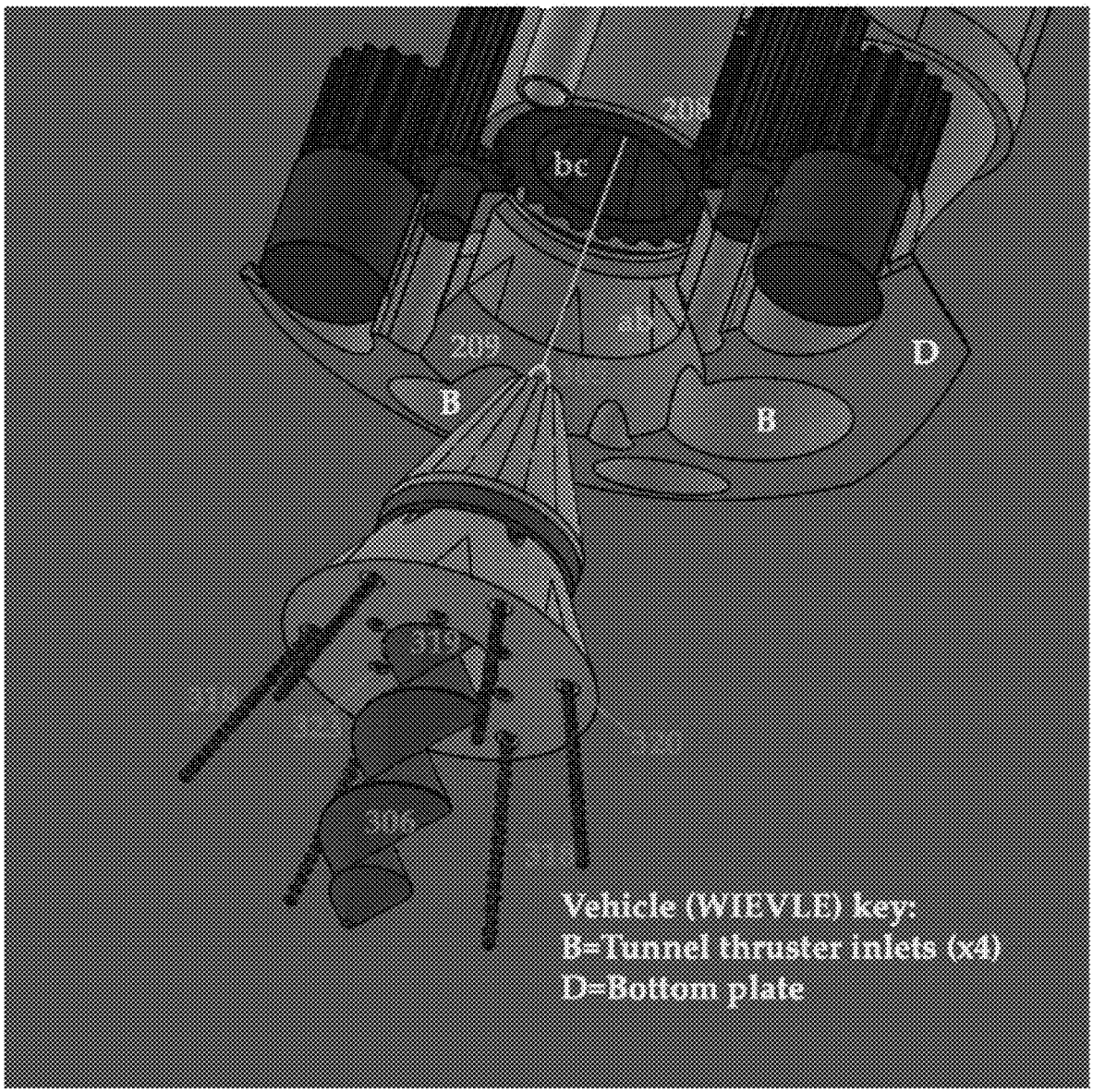
FIG. 6 shows RAATM anchor assembly components in the tethered position.

The anchor assembly components are depicted in FIG. 6 and labeled with 300 series reference characters/numbers. The anchor plug (316) forms the body of the anchor assembly and retains the anchor cap (317), with its embedded anchor spike (306), and the wire root array (318). It is seated at the base of the anchor sleeve (208) inside the beveled anchor port (209), and it is held in position by rare-earth (permanent) magnets (not depicted). Vertical splines (aa) on the anchor plug exterior align with corresponding beveled, vertical slots (ab) in the anchor port (209) to resist rotation during anchor cap (317) rotation. These grooves help guide and re-seat the anchor plug in position during the retraction of the tether. The anchor plug (316) and anchor cap (317) are made of Teflon to reduce fouling and minimize friction during the re-seating of the anchor plug into the anchor port, the passage of the anchor spike through the spike well (319), and the passage of the wire root array (318) through the root tunnels (320) in the anchor plug.

Figure 7:
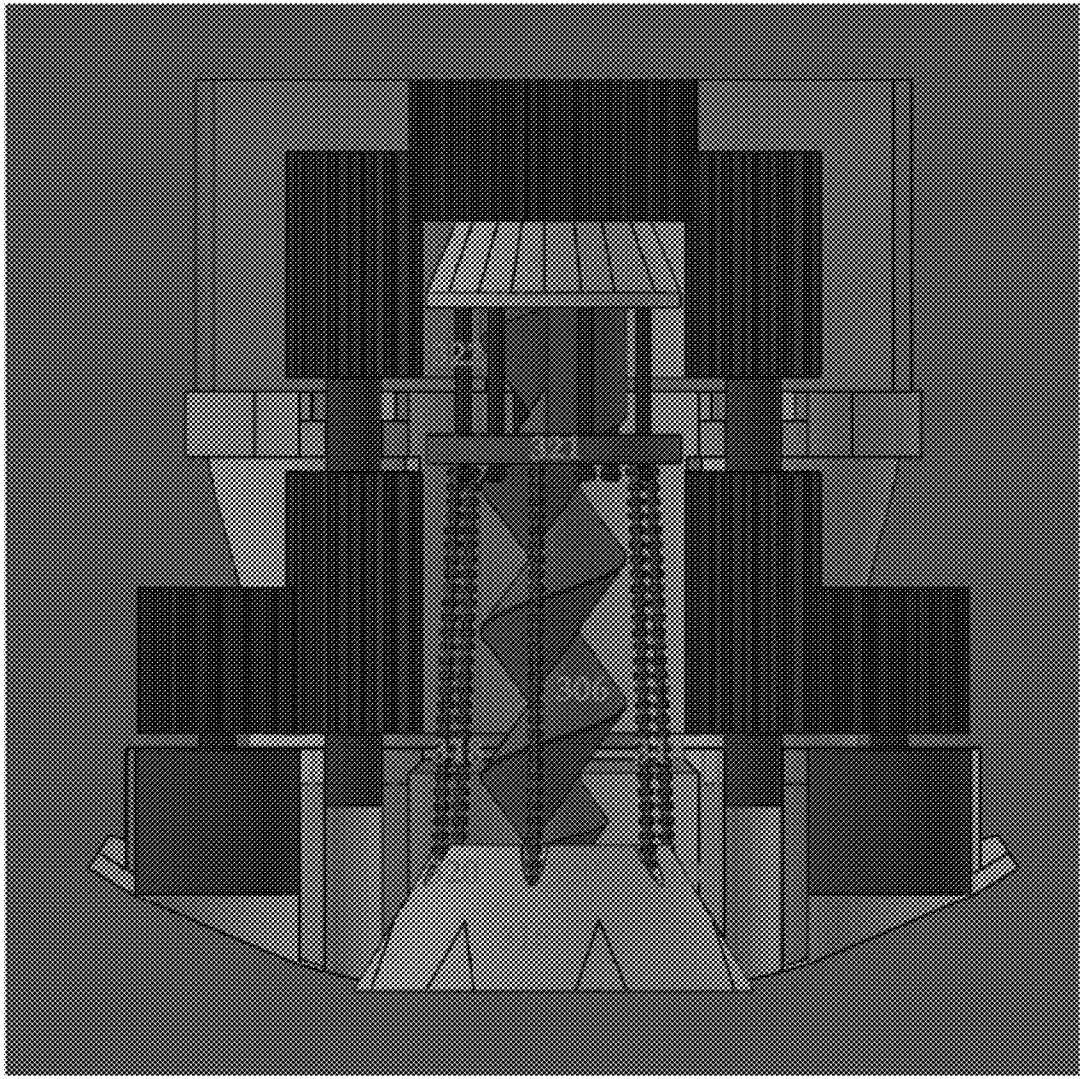
FIG. 7 shows RAATM wire root array sub-assembly components in the stowed position.

The outer surface of the head of the anchor cap is ribbed with vertical splines (bb) that mate with the corresponding splines (bc) of the concave interior surface of the anchor cap coupler, thereby enabling the anchor cap coupler to transmit torque to and rotate the anchor cap (317). The anchor spike (306) is rigidly affixed to the anchor cap and is ideally made of a material such as stainless steel to provide weight and add resilience. Thus, the anchor cap retains the anchor plug and provides a mounting point for the swivel eyelet (305). The anchor tether is connected to the anchor spike via a free-spinning swivel eyelet (305) that enables the anchor spike to rotate without winding the tether. The anchor spike is shaped like an auger, and it passes through correspondingly shaped spike well (319) to enable the contraction of the anchor assembly while also serving as the primary means of attachment of the anchor assembly to the seabed. The wire root array sub-assembly (b) is depicted in FIG. 7.

The anchor spike passes through a non-rotating, rigid metal washer known as the wire root ring (321), which joins the wire brush anchor roots into an array (318). The wire root array consists of a set of thin, flexible, stiff wire brushes with interwoven synthetic bristles made of a corrosion-resistant metal, such as braided stainless steel. Each brush passes through a corresponding root tunnel (320) within the anchor plug (316), which angles gradually outward from the vertical axis. The wire root ring (321) and wire root array (318) are stationary with respect to the anchor plug (316) as the anchor cap (317) and spike (306) are rotated and are held in this position by the wire root array, which is fixed within the root tunnels of the anchor plug, as well as a set of root ring retention rods (322). The purpose of the retention rods (322) is to delay the injection of the wire roots until the anchor spike has been extended a preset depth into the seabed and then retract the wire root array during the retraction of the anchor by pulling up on the root ring (321). The retention rods should be free to move within a lipped groove set in the lower face of the anchor cap (317), which provides retention to the upper ends of the rods. The retention rods pass freely through the root ring (321) and into corresponding vertical retention rod tunnels (323) within the anchor plug in the rooted position. The lower ends of the rods are capped such that the rods (322) may freely extend into the anchor plug during the seating of the anchor cap onto the anchor plug but retain the root ring (321) as the anchor spike is unscrewed into the fully retracted position, thus pulling the array out of the sediment and back into the root tunnels (320) of the anchor plug.

3.3. Sequence of Events

3.3.1. Stowed to Inject Position

Figure 8:
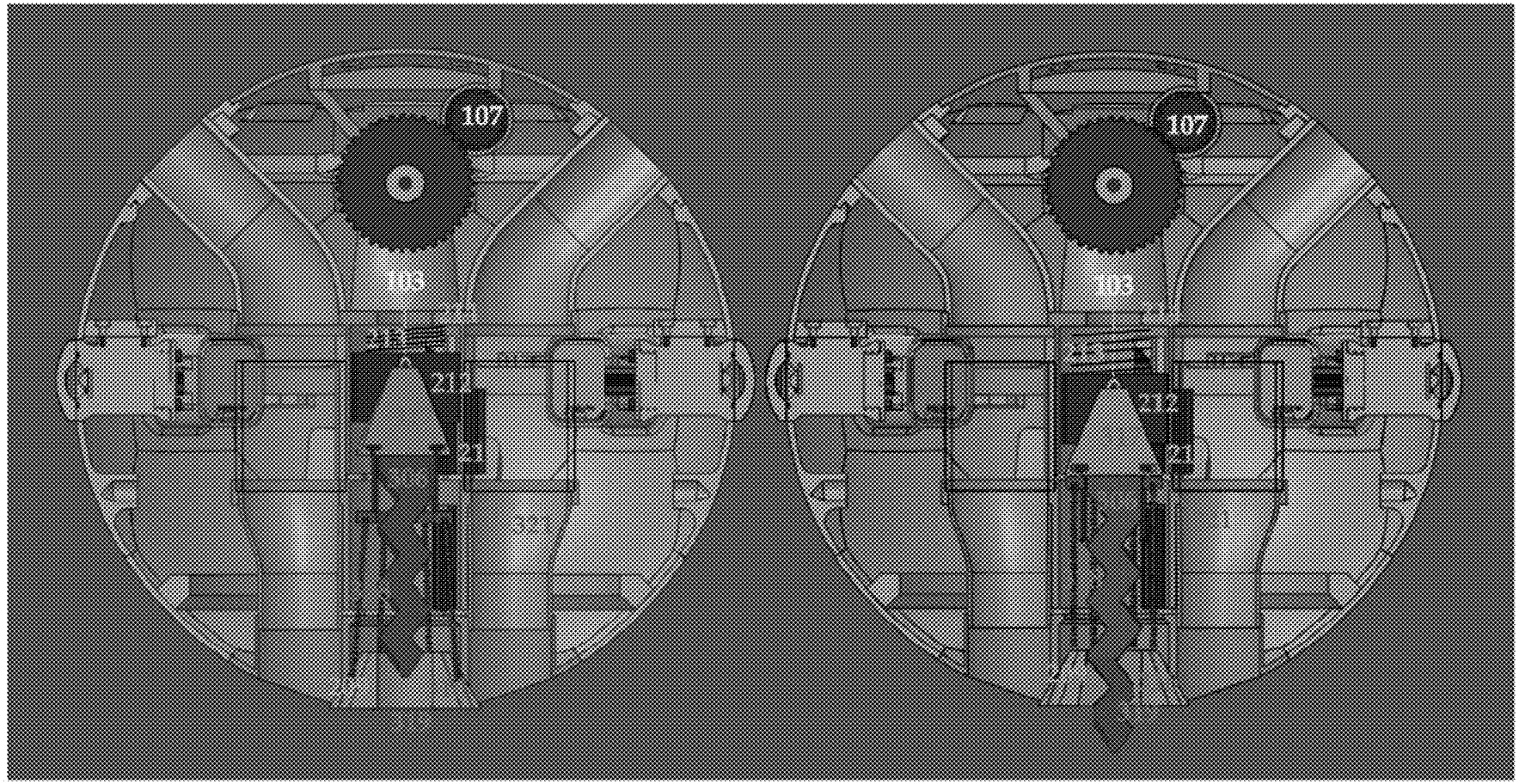
FIG. 8 shows RAATM phase transition from stowed (left) to inject (right) position.

In the stowed position, depicted in FIG. 7 and phase I of FIG. 2, the anchor assembly is completely enclosed within the anchor sleeve, the anchor spike is fully retracted, the anchor plug is flush with the bottom of the hull, and the AUV may maneuver normally, free of external protrusions. At the start of the anchoring sequence, the anchor spike (306) is extended through the spike well (319) at the bottom of the anchor plug (316) into the inject position, as depicted in phase II of FIG. 2, while the vehicle descends. An internal view of this phase transition is depicted in FIG. 8.

The protrusion of the anchor spike (306) enables the vehicle to leverage downward momentum to aid in the penetration of the seabed surface while simultaneously lowering the vehicle's center of gravity slightly and promoting a vertical orientation due to the increased righting moment caused by the increased vertical separation of the center of gravity from the center of buoyancy. The increased righting moment is especially helpful in the case of spherical AUVs, as proper vertical orientation further ensures that the bottom of the sphere will come into contact with the seabed first, and the anchor spike will be driven into the sediment more efficiently.

To position the anchor spike (306) into the inject position, the tether spool actuator (107) briefly tensions the tether (103), compressing the anchor spring (213) and releasing the tensioner latch; it then reverses to allow the spool to unwind freely and enable the anchor spring to expand against the anchor sleeve cap (214) and compress the anchor cap coupler (212) firmly onto the anchor cap (317). The vertical spur gear gears (210) are then rotated via electrical actuators adjacent to the anchor plug (316). The vertical spur gears (210) interface with the vertical outer splines of the anchor cap coupler (212) through slots in the anchor sleeve. The outer splines of the anchor cap coupler slide freely along the vertical spur gears as they rotate, transferring torque to the anchor cap (317) and spike (306), which rotates and extends the spike through the spike well (319). As the anchor spike is extended out the bottom of the anchor plug, the lower face of the anchor cap (317) contacts the wire root ring (321), causing it to be in position to be compressed by the anchor cap (317) when the anchor spike (306) is screwed further into the anchor plug (316) during the next phase of deployment. The anchor spike (306) is held in position by corresponding inner "threads" (not depicted) of the spike well (319) semi-rigidly, enabling sufficient resistance for impact and penetration of the surface of the seabed during the inject phase, while the wire root array (318) remains retracted within the anchor plug (316).

3.3.2. Inject to Rooted Position

Figure 9:
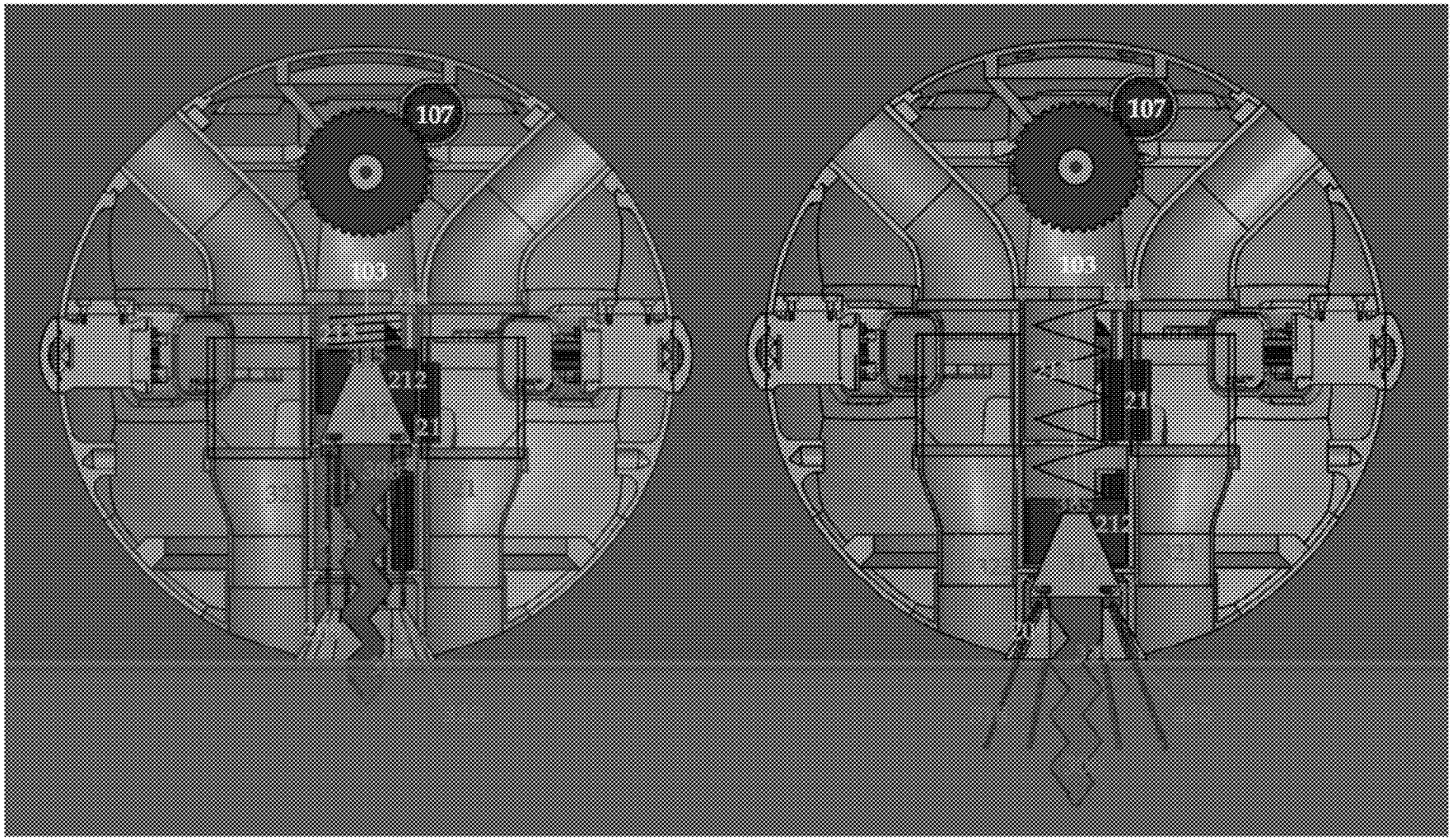
FIG. 9 shows RAATM phase transition from inject (left) to rooted (right) position.

As depicted in phases II-III of FIG. 2, the vehicle descends in the inject position until it firmly drives the protruding anchor spike tip into the sediment, thus initiating the rooting phase of operation. An internal view of the inject to rooted phase transition is depicted in FIG. 9.

Upon contact with the seabed, the anchor spike (306) is rotated further through the anchor plug (316), driving the anchor spike deeper into the sediment. To counter the reaction torque on the vehicle during augering, the vehicle must command an opposite yaw while maintaining downward force until the anchor cap (317) is fully seated in the anchor plug (316), unless the vehicle's weight or use external structure is sufficient to resist this torque.

As the anchor cap (317) is rotated, the spike extends further through the anchor plug (316) and deeper into the sediment. The swivel eyelet (305) at the top of the anchor spike prevents the tether (103) from twisting. The anchor cap (317) presses down on the wire root ring (321), freely rotating over the non-rotating ring and forcing the wire root array (318) through the root tunnels (320) as the root ring retention rods (322) drive into their corresponding wells within the anchor plug (316). The wire root bristles are driven into the sediment around the base of the anchor plug. When the anchor cap coupler (212) reaches the aft stops within the anchor sleeve, the anchor assembly is fully rooted.

3.3.3. Rooted to Tethered Position

Figure 10:
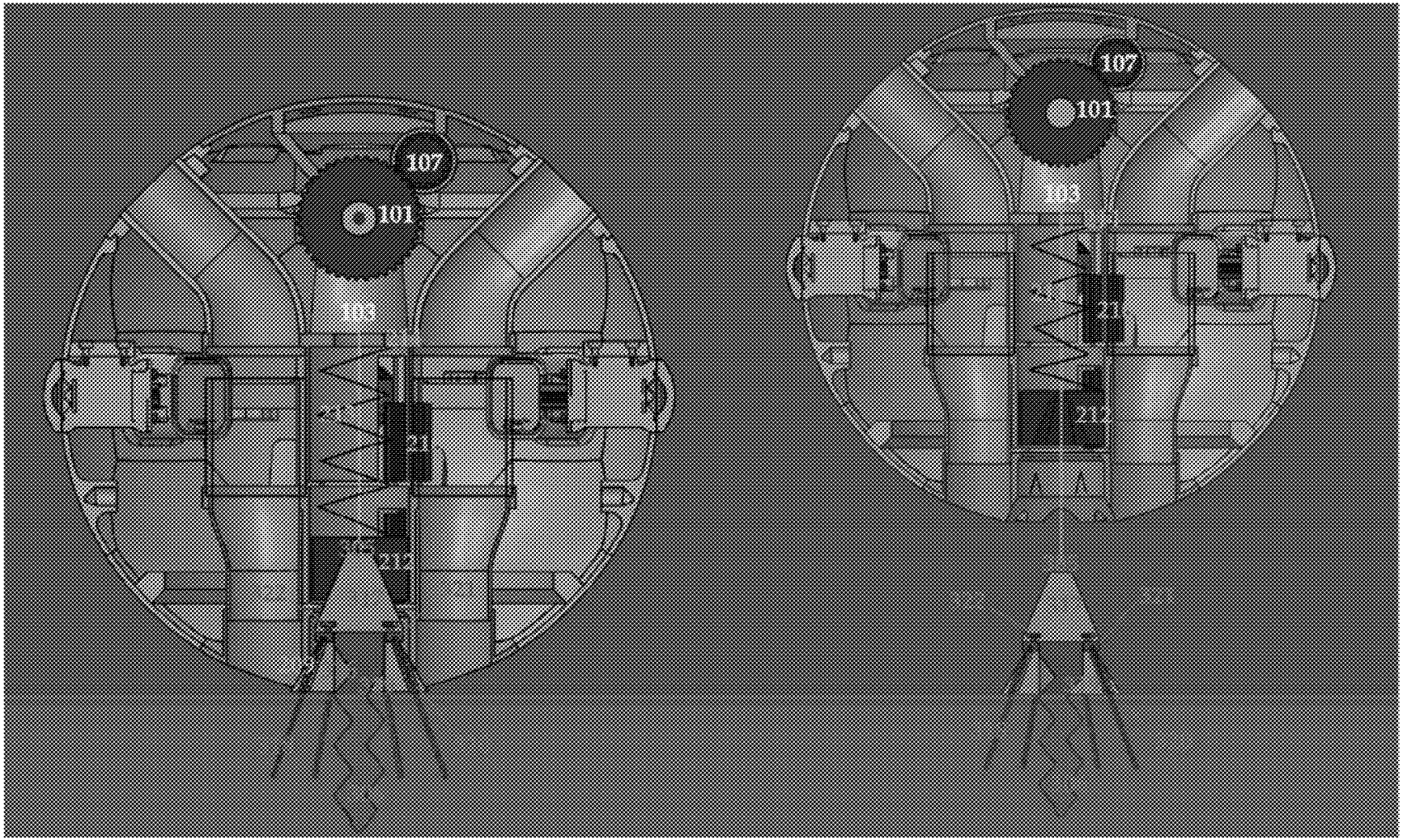
FIG. 10 shows RAATM phase transition from rooted (left) to tethered (right) position.

Once the anchor cap coupler (212) reaches the aft stop, counter-torque yaw and downward thrust is ceased, and a brief upward thrust may be commanded to unseat the anchor plug (316) as the tether spool (101) is allowed to rotate freely. If the anchor assembly holds fast to the sediment, the anchor plug is pulled free from its magnetic coupling and the vehicle ascends away from the anchor assembly into the tethered position, as depicted in phase IV of FIG. 2. An internal view of the transition from the rooted to tethered positions is depicted in FIG. 10.

Figure 11:
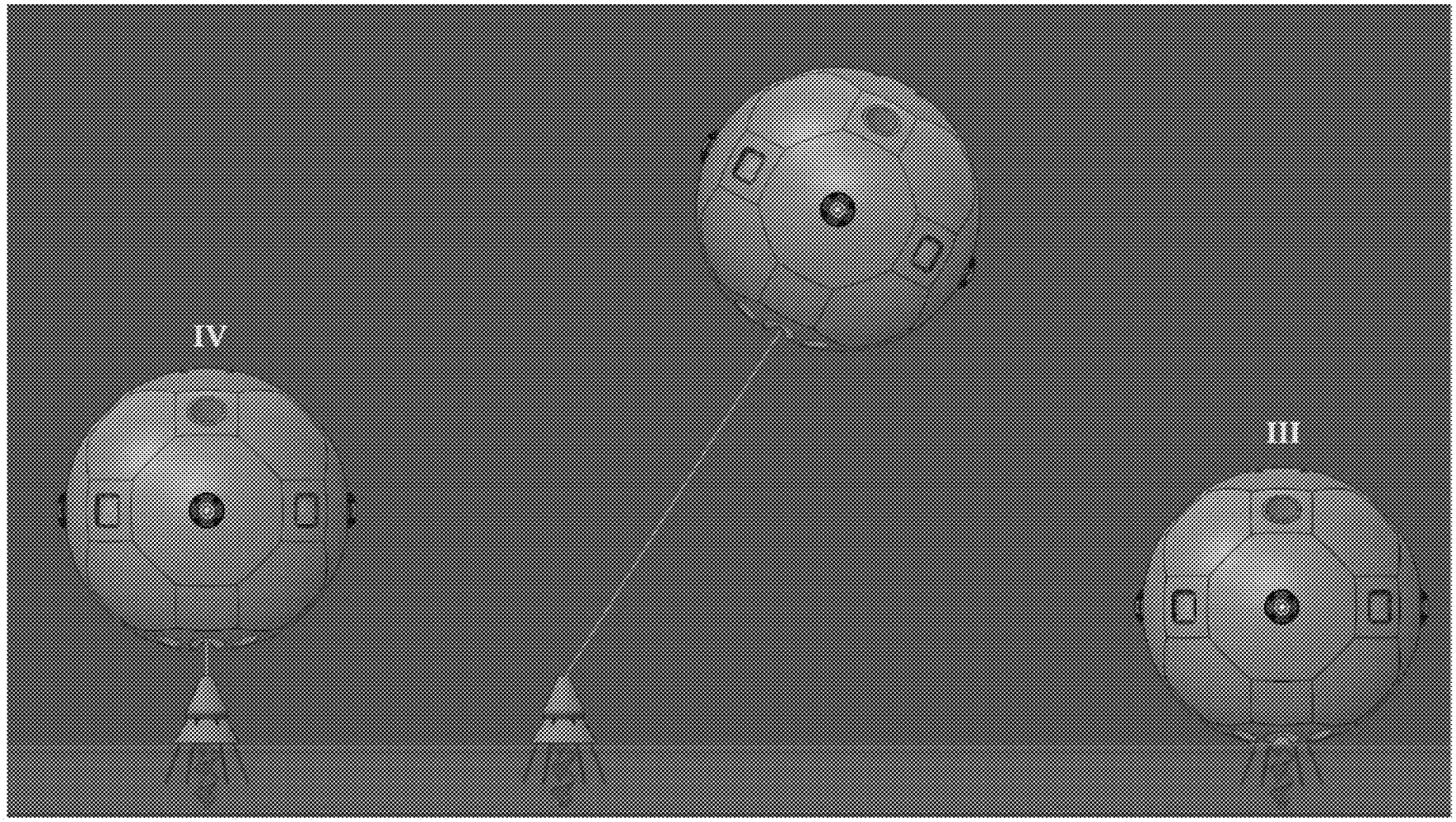
FIG. 11 shows The RAATM tether may be payed out to control depth or antenna length.

If the AUV is sufficiently buoyant, the vehicle may be able to ascend passively above the anchor assembly. Tether length can be adjusted as required for control of depth or antenna length by rotating the tether spool (101) to shorten or lengthen the tether (103), as depicted in FIG. 11.

3.3.4. Retraction

To retract the anchor and continue propagation, the AUV executes the reverse of the anchoring sequence. First, the spool actuator (107) rotates the tether spool (101) and winds the anchor tether (103) back onto the spool, reeling the vehicle back in toward the anchor assembly. The central guide hole in the anchor cap coupler (212) helps center and guide the anchor port (209) over the top of the anchor assembly as the final length of tether is retracted. When the anchor assembly contacts the anchor port, the beveled grooves (see ab of FIG. 6) of the anchor port (209) guide the anchor plug splines (aa) into position, and the plug (316) continues to seat. As the anchor plug nears the fully seated position, the magnets within the anchor port (209) and anchor plug pull the anchor plug firmly into the seated position, and the slack of the tether (103) is taken up by the tether spool (101). The vehicle has now returned to the rooted position (phase III of FIG. 11), and the vertical spur gears (210) engage the anchor cap coupler (212), loosening the anchor spike (306) through the anchor plug (316) and retracting it from the sediment. The anchor spring (213), still under compression, maintains the necessary downward force on the anchor cap coupler (212) to ensure coupling with the anchor cap (317). The loosening anchor cap continues to rise, passing through the inject position, until the lower caps of the root ring retention rods (322) contact the lower side of the wire root ring (321) and begin to pull the wire root ring upward, retracting the wire roots (318) back into the root tunnels (320). When the anchor spike (306) is fully retracted into the anchor plug (316), the anchor spring (213) is once again fully compressed, and the tether spool (101) can then be further rotated until the tensioner latch engages. The mechanism has then returned to the stowed position, and the vehicle is free to maneuver and repeat the process again as required.

3.4. Design of Experiments

Several experiments were developed to gain insight into the performance potential of the RAATM's anchoring function (anchoring strength) and the influence of the wire root array on anchoring strength by assessing the capability of the anchoring portion only (the wire roots and anchor spike components of the anchor assembly) to hold fast in various sediments when under tension. Toward this end, three primary research questions were investigated:

What effect does sediment type have on anchoring strength?

What effect does increasing the number of wire roots in the array have on anchoring strength?

What effect does combining the wire root array with the anchor spike have on the mechanism's ability to resist angled loads?

An experiment was designed for each research question, and a simple prototype of the lower portion of the anchor assembly (a partial anchor plug, an anchor spike, and a wire root array) was constructed. The construction of this prototype is discussed in Section 3.5. Three distinct types of sediments were collected from the local environment to test the anchoring strength of the assembly. The goal was to achieve the best possible representative sampling of possible seabed conditions (capable of penetration). The collection of sediments used is discussed in Section 3.6. The procedure for each experiment is discussed in Section 3.7, and the results are discussed in Section 4.

The first experiment was designed to answer the first research question by collecting data samples for anchor line tension (force) at the point of uprooting (hereafter referred to as anchoring strength) using the prototype. To test the correlation between sediment type and anchor strength, three distinct types of sediments with differing particle sizes were collected, with the prediction that smaller-particle-size sediment conditions would yield higher anchoring strength. The experimental null hypothesis, therefore, was that sediment type has no effect on anchoring strength. Three data cells consisting of 30 individual tests of anchor strength (hereafter referred to as "pulls") were collected for each of the three sediment conditions in Test 1 for comparative statistical analysis.

The second experiment was designed to answer the second research question by collecting anchoring strength data for the three sediment conditions using three configurations, under vertical loads, in order to understand the relative contribution of the number of wire roots in the array to the overall anchoring strength. The full array of eight wire roots was used for Test 1 of the first experiment. A partial array of four wire roots (Test 2) and no array at all (Test 3) were used for data collection in Experiment 2. The experimental null hypotheses were: the mean anchoring strength for each configuration is equal (H01), the mean anchoring strength for each condition is equal (H02), and there are no interactions between the factors (H03). Thus, nine data cells consisting of 30 pulls each were collected in Tests 1-3 for comparative statistical analysis.

Finally, the third experiment was designed to answer the third question by collecting anchoring strength data for the three sediment conditions using two anchor configurations—the full array of eight wire roots (Test 4) and no array at all (Test 5)—under angled loads, in order to understand the contribution of the full wire root array to resisting angled loads. The prediction was that the wire root array would aid the mechanism in resisting angled loads, with the corresponding null hypothesis that the wire root array would have no effect on resisting angled loads. Due to time and logistics constraints, ten pulls were conducted for each condition and configuration. The collected data were sufficient, however, for the comparative statistical analysis.

3.5. Construction

Figure 12:
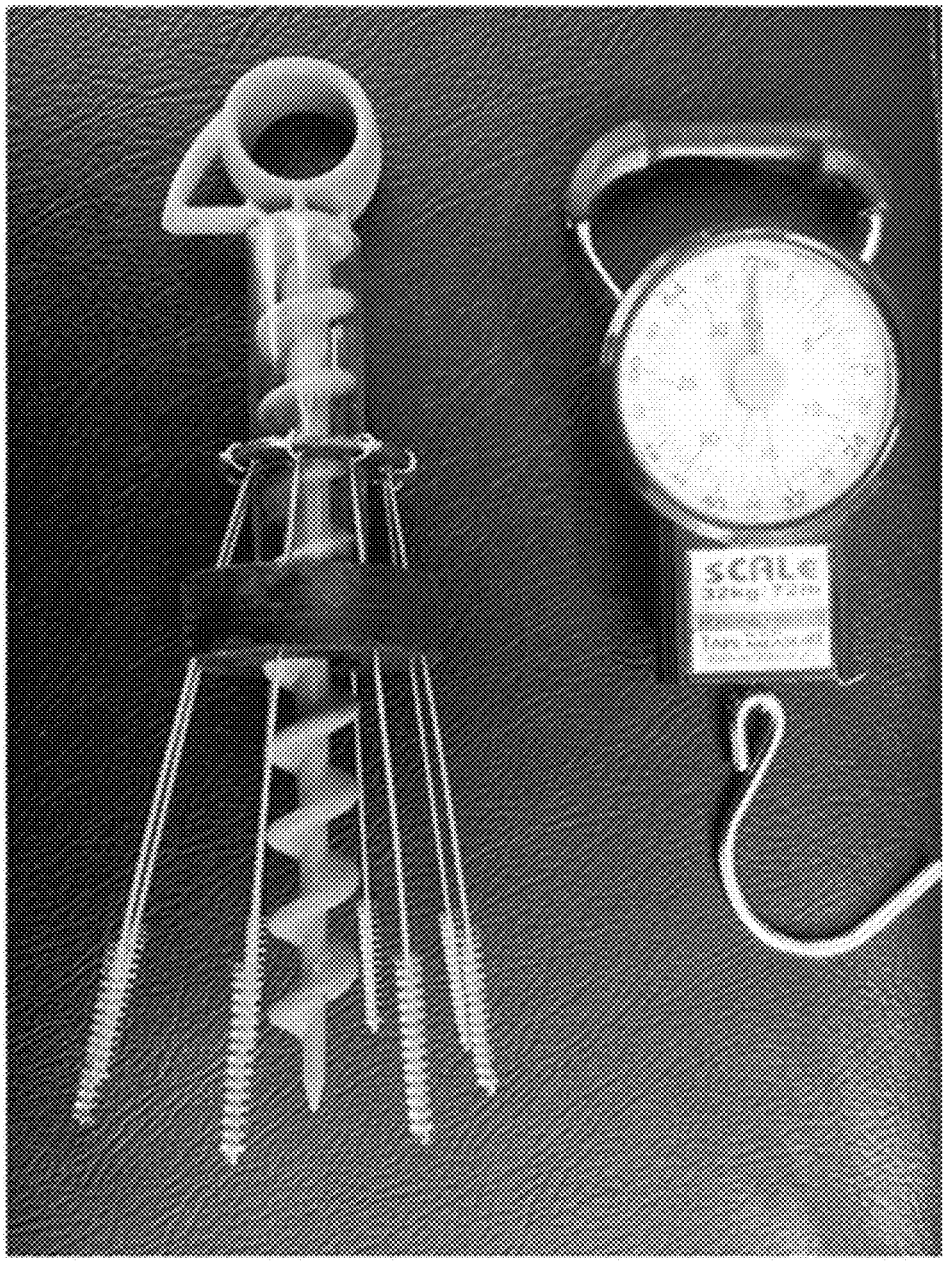
FIG. 12 shows The RAATM anchoring strength test prototype and scale.

The constructed prototype, depicted in FIG. 12, is very close to the correct dimensions for use within the WIEVLE's CPT.

For the purpose of the experiments, the concern was only the portion of the anchor assembly that penetrates the sediment and the method of insertion for each penetrating component. The test prototype, depicted in FIG. 12, was constructed from readily-available commercial materials and designed to allow the wire root array to be pushed into the sediment around the anchor spike, which was then augured into the sediment. The prototype consists of a green plastic anchor spike, a black wooden anchor plug, acrylic spacers, eight wire roots made from bottle brushes, and a wire root ring made from a steel flat washer.

The anchor spike is a common screw-type "beach anchor". This commercial product has smooth, rounded, tapered threads spaced approximately 1.9 cm per turn and 0.952 cm deep. The spike also narrows slightly overall along its length and measures approximately 1.9 cm in diameter along the 10.16 cm that insert into the sediment. It differs from the proposed mechanism primarily in material, being made of lightweight plastic instead of solid stainless steel that would have the added anchoring benefits of weight and durability.

Figure 13:
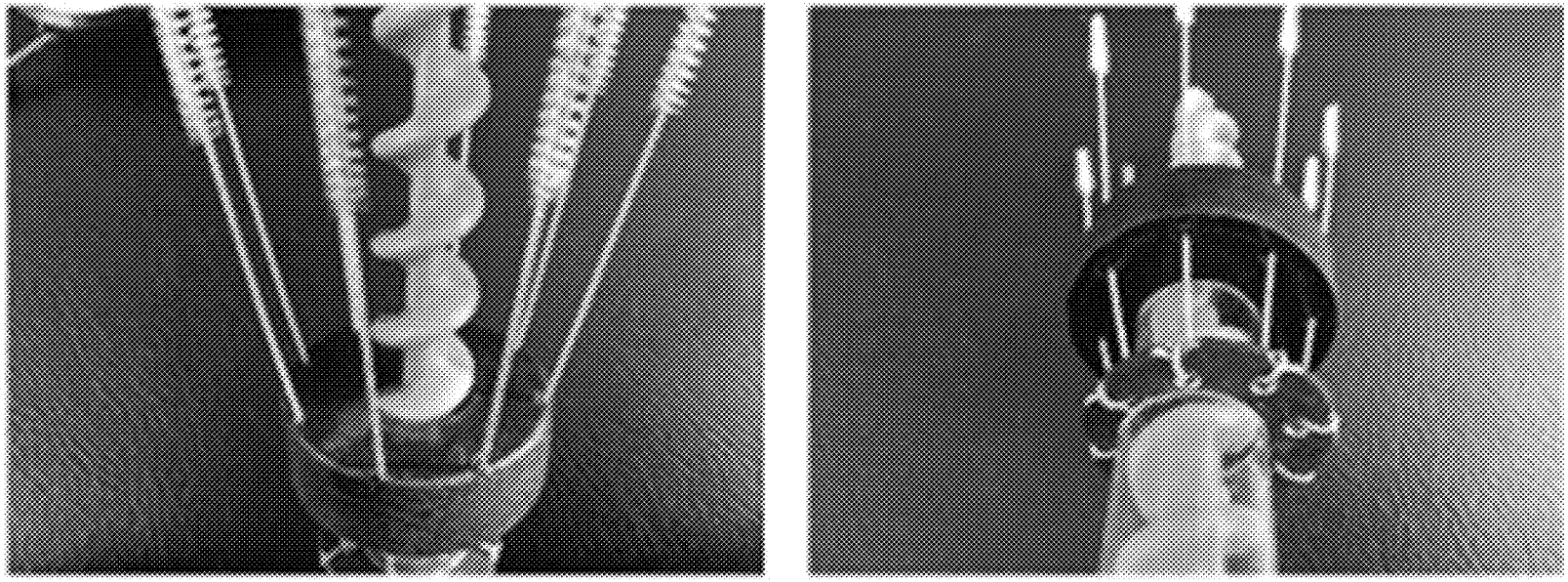
FIG. 13 shows Wire Root Array: (a) Wire roots extend symmetrically around the anchor spike; (b) The wire root ring provides the attachment point for the wire roots and allows the array to slide vertically.

The wire root array, depicted in FIG. 13, was assembled from eight 19.05 cm long 304 stainless steel braided wire pipe cleaners with nylon bristles 2.5 mm in length covering the last 3.175 cm of each brush.

The wire root ring was constructed from a 1.59 cm diameter steel flat washer. Eight holes were punched through the metal, and corresponding notches were cut along the outer edge to allow the braided wire to be secured yet free to rotate slightly as the array is inserted and retracted through the anchor plug. This wire root array is very similar to the proposed mechanism.

The anchor plug was constructed from a pine wood disk 5.715 cm in diameter, 1.9 cm thick with a 2.22 cm diameter central hole. Eight holes (root tunnels) for the wire brushes were drilled symmetrically at a slight angle along the perimeter. The angled root tunnels allow the wire roots to spread out conically into the sediment around the anchor spike as the ring is depressed. The wooden plug was painted to reduce water damage during testing. It differs somewhat from the proposed mechanism in both shape and material, yet it allows the required movements of the anchor spike and wire root array for testing purposes while providing sufficient support.

The plastic augers were sold with tight-fitting acrylic tubing for storage, which was cut and used to create spacers to ensure consistent deployment of the assembly into the testing sediment. A 2.54 cm spacer between the wire root ring and the anchor plug ensures the wire assembly is fully inserted by depressing the ring down until contact is made between the wire ring, the spacer, and the plug. A 5.4 cm spacer above the wire ring is used to ensure the plastic anchor spike is fully rotated into the sediment until contact is made between the thumb ring at the top of the spike, the spacer, and the wire ring (washer). Thus, when the assembly is fully inserted and all components are fully seated, a consistent 9.21 cm of wire roots and 10.16 cm of anchor spike is extended into the sediment.

3.6. Sediment Samples

Three types of sediment were collected to simulate potential seabed environments, as depicted in FIG. 14.

Figure 14A:
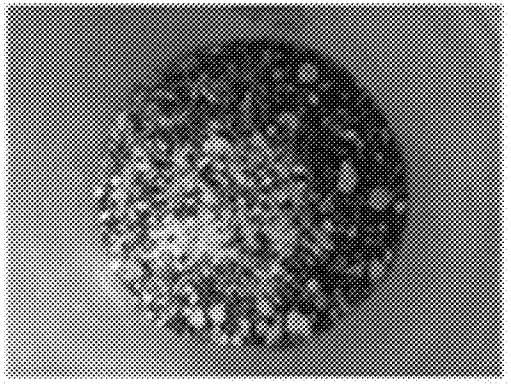
FIGS. 14A, 14B and 14C show Sediment Samples: (a) Condition 1: Clay and pebble mixture; (b) Condition 2: Fine silt; (c) Condition 3: Beach sand.
Figure 14B:
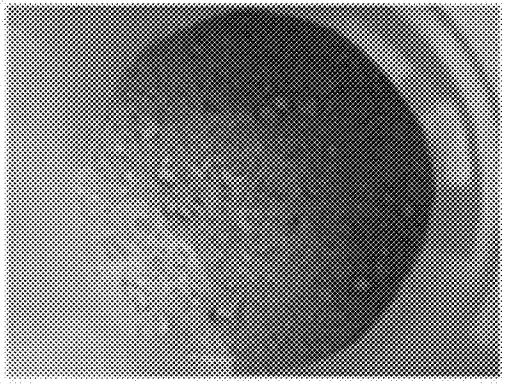
Figure 14C:
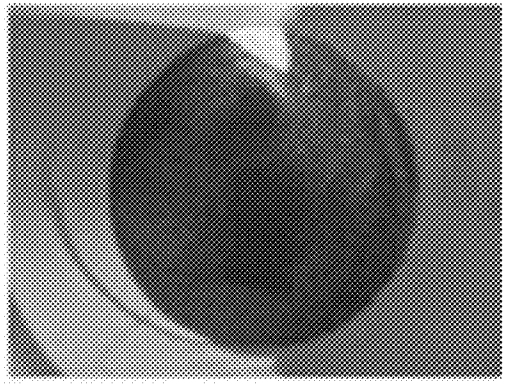

The first sample (condition 1), depicted in FIG. 14A, consists of a mixture of clay and asphalt pebbles collected along a rural road in Monterey, California. The second sample (condition 2), depicted in FIG. 14B, consists of fine, dark silt collected from the Monterey hillside to simulate river bottoms, freshwater lakebed sediments, or river silt deposits in littoral regions. The third sample (condition 3), depicted in FIG. 14C, consists of actual beach sand collected from Monterey Bay. Typical sediment particle sizes for clay, silt, and sand are generally <0.002 mm, 0.002-0.05 mm, and 0.05-2 mm, respectively [Refs.37,38]. The samples were collected in five-gallon buckets approximately 26.5 cm in diameter and filled to approximately equal depths sufficient for full rooting of the prototype. Fresh water was then added until a depth of approximately 10 cm above the fully saturated sediments was achieved. The buckets were then disturbed to help release trapped air bubbles and allowed to settle until off-gassing was observed to cease (for at least an hour) prior to testing.

3.7. Procedure

Figure 15A:
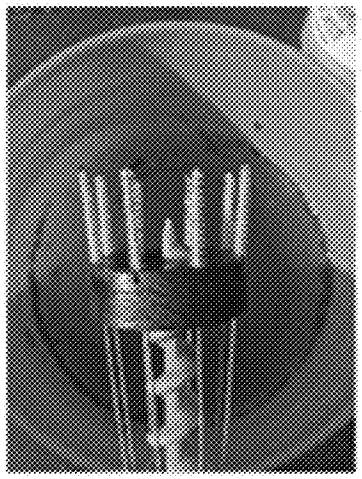
FIGS. 15A, 15B and 15C show Testing sequence: (a) Wire root array ready for inject; (b) Anchor assembly fully rooted; (c) Vertical pull test completed.
Figure 15B:
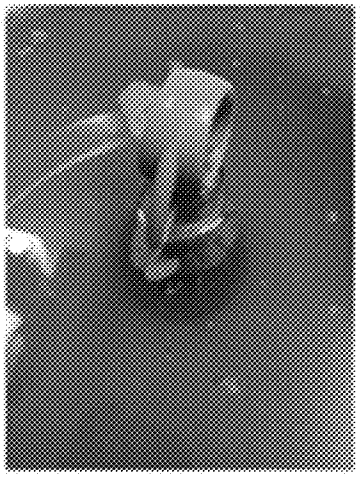
Figure 15C:
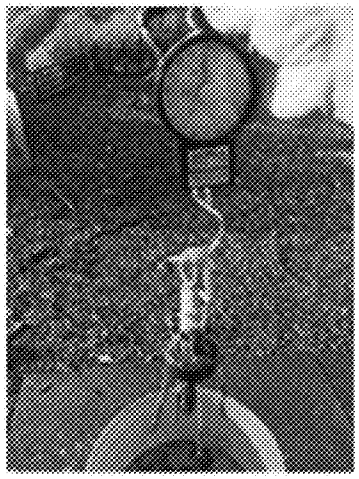

The testing sequence is depicted in FIG. 15.

A hand-held scale with a max weight indicator was checked for calibration and used to measure anchoring strength. During each pull, the wire root array was carefully inserted into the sediment and the root ring was depressed until it fully compressed the acrylic spacer onto the anchor plug resting on the sediment. Care was taken not to allow the plug itself to depress more than approximately 1 cm into the sediment or the wire roots to jam, tangle or otherwise fail to insert through the root tunnels in the anchor plug. The spike was then inserted through the wire root ring and anchor plug and carefully screwed into the sediment until firmly compressed against the upper spacer. The scale hook was then inserted through the thumb ring at the top of the plastic anchor spike, and the handle was smoothly pulled upward for the vertical tests, or at an approximately 45-degree angle for the angled tests, until the anchor released from the sediment. The angle was kept consistent for the angled pulls by keeping the scale handle just above the upper lip of the bucket during the pull, set to equal heights in all three sediment conditions, with the anchor rooted to the same depth and the scale attached at the same point (the thumb ring of the anchor spike). Care was taken to pull steadily without jerking the anchor free. The force was smoothly yet reasonably swiftly applied over a relatively short time period (approximately 1-2 s)—not as a jerk. The objective was to produce a consistent, steady pull through failure. We believe a jerk would give an unduly high strength measurement for the pulls. It is, however, worth noting that it is likely that in real-world scenarios, jerk force applications could influence anchoring strength. Such scenarios could reasonably be expected in shallow littorals affected by wave action, for example. Jerk force testing was outside the scope of testing for this early prototype analysis. Following the pull, the max tension (in pounds) was recorded. To prepare for the next pull, sediment was removed from the assembly, and a wooden block was used to firmly re-compact the sediment. The bucket was then rotated slightly so as to avoid using the exact same spot for the subsequent pull and help ensure the independence of the data.

Test 1 consisted of a sample of 30 straight (vertical) pulls using the full array of eight wire roots within the anchor plug and the spike fully inserted in each of the three sediments, for a total of 90 pulls. Test 2 was conducted in a similar manner, with the exception of the reduction in the total number of wire roots within the array to four, evenly spaced, again for a total of 90 pulls. Test 3 consisted of the same procedure, but with the anchor spike alone, inserted to the same depth as in all the other tests, once again for 90 pulls. Test 4 consisted of ten pulls in each of the three sediment types using the full wire root array (eight wires) but this time pulling at an angle of approximately 45 degrees, for a total of 30 pulls. Test 5 was conducted in the same manner as Test 4 but without the wire root array (anchor spike only), again for a total of 30 pulls.

4. Results

A total of 330 pull tests were conducted, the results of which are given in Table 1 shown in FIG. 16.

1. Discussion 5.1. Experiment 1

The clay/pebble mixture (condition 1) and fine silt (condition 2), once sufficiently settled, produced very similar mean anchoring strengths of 16.9 lbf and 16.1 lbf, respectively. Beach sand, however, produced a mean anchoring strength of only 4.3 lbf, or approximately 25% of that of the first two conditions. A one-way, single-factor analysis of variance (ANOVA) was conducted comparing the anchor strength data for the three sediment conditions collected in Test 1 with a significance level of 0.05, with a resulting f-value of 162.222 that exceeded the f-critical value of 3.101 and a p-value of 4.431×10-30. Thus, we conclude that the influence of sediment condition on mean anchoring strength is significant, with a 95% confidence level. The variances for conditions 1, 2, and 3 (14.81 lbf, 11.94 lbf, and 1.07 lbf, respectively) demonstrate a likelihood of unequal population variances, however.

Thus, three two-sample t-tests (two-tailed) were conducted, assuming unequal variances at a significance level of 0.05, to confirm which groups had significantly differing means.

The first t-test compared the anchoring strength data for conditions 1 and 2, with a resulting t-statistic of 0.851 and a p-value of 0.398; therefore, we conclude that a significant difference does not exist between the mean anchor strength for condition 1 vs. condition 2. The second t-test compared the anchoring strength data for conditions 2 and 3, with a resulting t-statistic of 17.985 and a p-value of 6.076×10−19; thus, we conclude that a significant difference does exist between the mean anchor strength for condition 2 vs. condition 3. Finally, the t-test comparing the anchoring strength data for conditions 1 and 3, with a resulting t-statistic of 17.381 and a p-value of 3.552×10−18, allows us to conclude that a significant difference does exist between the mean anchor strength for condition 1 vs. condition 3.

As predicted, the Experiment 1 analysis confirmed, at a 95% confidence level, that sediment type does have a significant influence on anchoring strength, but only between condition 3 (sand) and the other two conditions (clay/pebble mixture and silt). No significant difference in mean anchoring strength exists between clay/pebble mixture and silt.

5.2. Experiment 2

The effect of the number of wire roots on anchoring strength was somewhat surprising, with Test 2, utilizing a partial array, producing unexpectedly high mean anchoring strengths. Test 2, configured with a four-root partial array, produced mean anchoring strengths for sediment conditions 1-3 of 19.3 lbf, 30.9 lbf, and 3.9 lbf, respectively. Test 3, configured with the anchor spike only, produced mean anchoring strengths for conditions 1-3 of 15.3 lbf, 15.9 lbf, and 2.0 lbf, respectively.

A two-factor ANOVA with replication was conducted. The first null hypothesis (that the mean anchoring strengths for each configuration are equal) is rejected with an f-value of 96.928, an f-critical value of 3.03, and a p-value of 3.30×10−32. The second null hypothesis (that the mean anchor failure tensions for each sediment condition are equal) is rejected again, as it was in Experiment 1, with an f-value of 611.065, an f-critical value of 3.03, and a p-value of 3.41×10−99. Finally, the third null hypothesis (that there are no interactions between the factors) is rejected with an f-value of 45.679, an f-critical value of 2.406, and a p-value of 4.59×10−29.

As expected per our hypothesis, the average anchoring strength for condition 3 (beach sand) decreases from a full array to a partial array, to none. In conditions 1 and 2, however, the partial array produced much higher anchoring strength than the full array. Two potential explanations for this unexpected result are offered. First, due to a several-day-long delay in testing between Tests 1 and 3 (the full array and no array, respectively) and Test 2 (the partial array), continued settling and firming were observed for conditions 1 and 2. For efficiency, the full-array tests were conducted first before removing four of the roots to conduct the partial array tests. Settling time, combined with decreasing ambient air temperatures, may have caused stiffening of the clay and silt samples, leading to higher anchor failure tensions. The beach sand, by contrast, being very homogeneous and stable, provided a more reliable test environment, and the resulting mean anchoring strengths behaved according to our hypothesis. Second, the wire roots, when in the partial array configuration, were prone to tangling during injection, leading frequently to a snarled deployment within the clay and silt samples. This, especially when combined with firmer sediment, may have contributed to the higher anchoring strengths. Such behavior, although more effective at holding fast, could be catastrophic in an actual deployment because it might prevent the successful retraction of the array. It is recommended that those seeking to replicate this experiment ensure sample equilibrium before collecting test data by conducting standardized pulls at regularly-spaced time intervals until a consistent anchoring strength is achieved for a particular sediment sample.

To determine whether the presence of the complete array contributed significantly to anchoring strength under vertical loads, a two-sample t-test, assuming unequal variances and with a significance level of 0.05, was conducted to compare the data from Test 1 (full array) with those of Test 3 (spike only) for each sediment condition. Three two-sample t-tests, assuming unequal variances, were conducted comparing the anchoring strength data for conditions 1-3 of Tests 1 and 3, with a significance level of 0.05. The first t-test, comparing condition 1 samples, resulted in a t-statistic of 1.784 and a two-tailed p-value of 0.08. The second t-test, comparing condition 2 samples, resulted in a t-statistic of 0.219 and a two-tailed p-value of 0.828. The third t-test, comparing condition 1 samples, resulted in a t-statistic of 11.563 and a two-tailed p-value of 1.662×10-13. Thus, we conclude that a significant difference does not exist between the mean anchoring strengths of the mechanism with the full wire root array vs. without the array for sediment conditions 1 and 2, but does exist for condition 3, at a 95% confidence level.

In summary, the Experiment 2 analysis confirmed, at the 95% confidence level, that both sediment condition and wire root array configuration do have a significant influence on anchoring strength (with significant interactions) under vertical loading; specifically, it was found that the complete array significantly increases anchoring strength under vertical loads in sand (with larger particle sizes) but not in clay or silt (with smaller particle sizes).

5.3. Experiment 3

Tests 4 and 5 produced anchoring strength data under angled loading of the type that would be experienced in a current pushing the tethered AUV some lateral distance away from the anchor plug (as depicted in FIG. 11), thus enabling analysis in support of question 3. The wire root array was specifically designed to address this situation; thus, the hypothesis was that the array would aid in anchoring strength. Experiment 3 testing consisted of ten angled pulls for each sediment condition, for a total of 30 pulls, for both configurations. Test 4, which was conducted using the full wire root array, produced mean anchoring strengths for conditions 1-3 of 21.9 lbf, 22.5 lbf, and 3.2 lbf, respectively. Test 5, which was conducted without the wire root array, provided average failure tensions of 15.5 lbf, 12.1 lbf, and 1.2 lbf, respectively.

Three two-sample t-tests, assuming unequal variances, were conducted comparing the anchoring strength data for conditions 1-3 of Tests 4 and 5, with a significance level of 0.05. The first t-test, comparing condition 1 samples, resulted in a t-statistic of 3.365 and a two-tailed p-value of 0.00345. The second t-test, comparing condition 2 samples, resulted in a t-statistic of 7.841 and a two-tailed p-value of 2.786×10-6. The third t-test, comparing condition 3 samples, resulted in a t-statistic of 9.553 and a two-tailed p-value of 1.165×10−6. Thus, we conclude that a significant difference does exist between the mean anchoring strength of the mechanism with the full wire root array vs. without the array, in all three sediment conditions, at a 95% confidence level. When comparing the data to the Experiment 1 data, it is notable that angled anchoring strength with the full wire root array (Test 4) was greater for conditions 1 and 2 than under straight tension (Test 1), but, unexpectedly, was less than under straight tension for condition 3.

A final observation made during Experiment 3 was that, as expected, anchoring strength increases under angled tension when the tether connection point is closer to the base of the anchor plug, likely due to the decreased moment arm. For convenience in Tests 4 and 5, the scale's hook was connected at the same point (the thumb ring at the top of the plastic screw) during the angled pulls as was used during the vertical pulls. This point is several centimeters higher than the tether would be connected (via the anchor spike swivel) in the proposed design. Eight additional pulls were conducted separately from Tests 4 and 5 in a modified configuration with the scale hook connected on a line tied just above the root ring in condition 1 sediment. This configuration produced a mean anchoring strength of 25.0 lbf, which appears higher than the mean anchoring strength for condition 1 of Test 4 (21.9 lbf), as expected.

6. Conclusions

The three experiments highlighted several important design considerations for both the mechanism itself and future experimental testing. During testing, it quickly became apparent that it is very difficult to push an array of slender wire roots through the anchor plug, especially in sediment conditions 1 and 2, and even more so with a partial (four-root) array. Based on the experiments, it was determined that the flexible wire roots be sufficiently rigid to be pushed directly, unsupported, into the expected sediment for the full depth without excessive flexion or kinking. The short prototype anchor plug also did not provide sufficient support to the wire roots during the repeated deployments to prevent bending and kinking, which required considerable effort to straighten and repair between pulls. A complete RAATM anchor plug prototype must provide sufficient tunnel length to prevent this damage to the wire roots. The root tunnel bores within the anchor plug should be sufficiently large and smooth to provide stability to the wire roots with minimum friction during insertion and retraction, when bristles are likely to be fouled. Over repeated testing, we observed that the nylon bristles did become quite fouled by the silt and clay sediments, although this did not appear to appreciably degrade anchoring strength during the testing period. Additionally, the total anchor plug height should be kept as low as possible to maximize strength under angled tension, as described in Section 5.3.

Some portions of the detailed description herein are presented in terms of algorithms and symbolic representations of operations on data bits performed by conventional computer components, including a central processing unit (CPU), memory storage devices for the CPU, and connected display devices. These algorithmic descriptions and representations are the means used by those skilled in the data processing arts to most effectively convey the substance of their work to others skilled in the art. An algorithm is generally perceived as a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be understood, however, that all of these and similar terms are to be associated with the appropriate physical quantities and are merely convenient labels applied to these quantities. Unless specifically stated otherwise, as apparent from the discussion herein, it is appreciated that throughout the description, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

The exemplary embodiment also relates to an apparatus for performing the operations discussed herein. This apparatus may be specially constructed for the required purposes, or it may comprise a general-purpose computer selectively activated or reconfigured by a computer program stored in the computer. Such a computer program may be stored in a computer readable storage medium, such as, but is not limited to, any type of disk including floppy disks, optical disks, CD-ROMs, and magnetic-optical disks, read-only memories (ROMs), random access memories (RAMs), EPROMs, EEPROMs, magnetic or optical cards, or any type of media suitable for storing electronic instructions, and each coupled to a computer system bus.

The algorithms and displays presented herein are not inherently related to any particular computer or other apparatus. Various general-purpose systems may be used with programs in accordance with the teachings herein, or it may prove convenient to construct more specialized apparatus to perform the methods described herein. The structure for a variety of these systems is apparent from the description above. In addition, the exemplary embodiment is not described with reference to any particular programming language. It will be appreciated that a variety of programming languages may be used to implement the teachings of the exemplary embodiment as described herein.

A machine-readable medium includes any mechanism for storing or transmitting information in a form readable by a machine (e.g., a computer). For instance, a machine-readable medium includes read only memory ("ROM"); random access memory ("RAM"); magnetic disk storage media; optical storage media; flash memory devices; and electrical, optical, acoustical or other form of propagated signals (e.g., carrier waves, infrared signals, digital signals, etc.), just to mention a few examples.

The methods illustrated throughout the specification, may be implemented in a computer program product that may be executed on a computer. The computer program product may comprise a non-transitory computer-readable recording medium on which a control program is recorded, such as a disk, hard drive, or the like. Common forms of non-transitory computer-readable media include, for example, floppy disks, flexible disks, hard disks, magnetic tape, or any other magnetic storage medium, CD-ROM, DVD, or any other optical medium, a RAM, a PROM, an EPROM, a FLASH-EPROM, or other memory chip or cartridge, or any other tangible medium from which a computer can read and use.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

What is claimed is:

1. An underwater vehicle comprising:

a hull;

a propulsion system operatively associated with propulsion of the hull;

an electrical energy storage system;

an anchoring system; and at least one controller operatively powered by the electrical energy storage system, and the controller operatively associated with controlling the propulsion system and the anchoring system, the anchoring system including:

a tether joined to a spool at a first end and an anchor at a second end, wherein the tether is retained by the spool and retracted by a first electronic actuator, and the anchor includes an internally stowed metallic auger passing through an anchor plug located on an external surface of the hull, the anchor includes an array of wire bristles retained by a ring, and the anchor is driven by a second electronic actuator operatively associated with driving an anchor cap operatively engaging the anchor; and a frame including a bracket retaining the spool, a cylinder interfacing with internal and external gear couplings driven by the second electronic actuator, and a spring retained by a cylinder cap, wherein the internal and external gear couplings driven by the second electronic actuator, and the spring operate to eject the anchor from the hull and retract the anchor into the hull from an ejected position.

2. The underwater vehicle according to claim 1, wherein the anchoring system tether and the spool are made of a conductive material, and one or both of the tether and spool are operatively connected to a transceiver housed within the hull, and the tether operates as an antenna.

3. The underwater vehicle according to claim 2, wherein the anchoring system tether is a target length when deployed, wherein the target length corresponds to a wavelength of an electromagnetic signal received by the antenna.

4. The underwater vehicle according to claim 1, further comprising:

ring retention rods operatively connected to the ring which retains the array of wire bristles and the ring retention rods operatively connected to the anchor cap, wherein the length of the ring retention rods is a predetermined length which delays an injection of the wire bristles into a seabed until the anchor has been extended a predetermined depth into the seabed.

5. The underwater vehicle according to claim 4, wherein the anchor plug includes clearance holes which provide channels for extending the ring retention rods thru the anchor plug.

6. The underwater vehicle according to claim 1, wherein the controller is configured to execute computer instructions to perform a method of:

stowing the anchor within the hull of the underwater vehicle;

injecting the anchor into a seabed;

rooting the anchor to the seabed;

pay out and retract a length of tether to set vehicle depth;

transmit and receive electromagnetic signals via the tether and retracting the anchor from the seabed and stowing the anchor within the hull of the underwater vehicle.

7. The underwater vehicle according to claim 6, wherein the step of injecting the anchor into the seabed includes ejecting the anchor spike to a predetermined length from the hull where the wire bristles remain internal to the anchor, and the step of rooting the anchor to the seabed includes driving the wire bristles into the seabed while augering the anchor spike deeper into the sediment.

8. The underwater vehicle according to claim 6, wherein the anchor is a spike and the step of injecting the anchor into the seabed and the step of rooting the anchor to the seabed includes mechanically rotating the anchor spike deeper into the seabed while applying counter-yaw propulsion to the underwater vehicle.

9. The underwater vehicle according to claim 1, wherein the wire bristles have a profile which provides engagement of the wire bristles into the seabed when the anchor is rooted in the seabed.

10. The underwater vehicle according to claim 1, wherein the hull includes an anchor docking port which includes magnets to retain the anchor while in the stowed position.

11. A method for deploying an underwater vehicle comprising:

stowing an anchor assembly within an anchor sleeve of the underwater vehicle;

while the underwater vehicle is descending to a seabed, extending an anchor spike of the anchor assembly to protrude from the underwater vehicle;

after the underwater vehicle contacts the seabed, using an anchor driving system housed within the underwater vehicle to mechanically rotate the anchor spike deeper into the seabed while applying counter-yaw propulsion to the underwater vehicle;

the underwater vehicle applying upward propulsion thrust to disconnect the underwater vehicle from the anchor while retaining a tethered connection to the anchor assembly, and positioning the underwater vehicle at a target tether length from the anchor assembly;

a transceiver, operatively connected to the tether, receiving an electromagnetic signal from an external source that corresponds to the target tether length; and the underwater vehicle retracting the tether to reattach the underwater vehicle to the anchor assembly.

12. An underwater vehicle anchoring mechanism comprising:

a tether joined to a spool serving as a transceiver connection at a first end and an anchor assembly at a second end, wherein the tether is retained by the spool and retracted by an electronic actuator;

the anchor assembly including an internally-stowed anchor including a metallic auger passing through a plug externally fixed to a hull of an associated underwater vehicle, wherein the anchor is driven by an anchor cap coupler housed within the associated underwater vehicle and the anchor assembly includes an array of longitudinally extended wire bristles retained by a ring; and a frame including a bracket retaining the spool, and a cylinder including an interface with internal and external gear couplings to drive the anchor assembly, and the cylinder including a spring retained by a cap, wherein the spring exerts downward pressure on the anchor assembly, at least in part, for driving the anchor into a seabed.

13. The underwater vehicle anchoring mechanism according to claim 12, wherein the tether and the spool are made of a conductive material, and one or both of the tether and spool are operatively connected to a transceiver housed within a hull of the associated underwater vehicle and the tether operates as an antenna.

14. The underwater vehicle anchoring mechanism according to claim 13, wherein the tether is a target length when deployed, wherein the target length corresponds to a wavelength of an electromagnetic signal received by the antenna.

15. The underwater vehicle anchoring mechanism according to claim 12, further comprising:

ring retention rods operatively connected to the ring which retains the array of wire bristles and the ring retention rods operatively connected to the anchor cap, wherein the length of the ring retention rods is a predetermined length which delays an injection of the wire bristles into a seabed until the anchor has been extended a predetermined depth into the seabed.

16. The underwater vehicle anchoring mechanism according to claim 12, wherein the anchor plug includes clearance holes which provide channels for extending the ring retention rods thru the anchor plug.

17. The underwater vehicle anchoring mechanism according to claim 12, wherein an operatively associated controller is configured to execute computer instructions to perform a method of:

stowing the anchor within the hull of the associated underwater vehicle;

injecting the anchor into a seabed;

rooting the anchor to the seabed; and retracting the anchor from the seabed and stowing the anchor within the hull of the associated underwater vehicle.

18. The underwater vehicle anchoring mechanism according to claim 17, wherein the step of injecting the anchor into the seabed includes ejecting the anchor to a predetermined length from the hull where the wire bristles remain internal to the anchor, and the step of rooting the anchor to the seabed includes driving the wire bristles into the seabed.

19. The underwater vehicle anchoring mechanism according to claim 17, wherein the anchor is a spike and the step of injecting the anchor into the seabed and the step of rooting the anchor to the seabed includes mechanically rotating the anchor auger deeper into the seabed while applying counter-yaw propulsion to the associated underwater vehicle.

20. The underwater vehicle anchoring mechanism according to claim 12, wherein the wire bristles have a profile which provides engagement of the wire bristles into the seabed when the anchor is rooted in the seabed.

* * * * *